US010202808B2

(12) United States Patent
Kannegaard et al.

(10) Patent No.: US 10,202,808 B2
(45) **Date of Patent: *Feb. 12, 2019**

(54) OFFSHORE DRILLING RIG AND A METHOD OF OPERATING THE SAME

(71) Applicant: Maersk Drilling A/S, Kgs. Lyngby (DE)

(72) Inventors: Michael Kannegaard, Espergaerde (DE); Allan McColl, Glasgow (GB); Jesper Holck, Humlebaek (DE)

(73) Assignee: MAERSK DRILLING A/S, Copenhagen (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/647,362

(22) Filed: Jul. 12, 2017

(65) Prior Publication Data

US 2018/0002987 A1 Jan. 4, 2018

Related U.S. Application Data

(63) Continuation of application No. 14/777,017, filed as application No. PCT/EP2014/055312 on Mar. 17, 2014, now Pat. No. 9,714,546.

(Continued)

(51) Int. Cl.
*E21B 15/02* (2006.01)
*E21B 19/084* (2006.01)

(Continued)

(52) U.S. Cl.
CPC ..... *E21B 15/02* (2013.01); *E21B 3/02* (2013.01); *E21B 7/12* (2013.01); *E21B 19/004* (2013.01);

(Continued)

(58) Field of Classification Search
CPC ..... E21B 15/02; E21B 19/084; E21B 19/143; E21B 21/001; E21B 3/02; E21B 7/12
See application file for complete search history.

(56) References Cited

U.S. PATENT DOCUMENTS 2,999,549 A * 9/1961 Stratton ..... E21B 7/128 175/5
4,341,373 A 7/1982 Mouton, Jr.

(Continued)

FOREIGN PATENT DOCUMENTS

DK 168770 B1 6/1994
KR 10-2012-0059820 A 6/2012

(Continued)

OTHER PUBLICATIONS

International Search Report (PCT/ISA/210) dated Jun. 18, 2015, by the European Patent Office as the International Searching Authority for International Application No. PCT/2014/055312.

(Continued)

*Primary Examiner* — James G Sayre
(74) *Attorney, Agent, or Firm* — Buchanan Ingersoll & Rooney PC

(57) ABSTRACT

An offshore drilling rig includes a drill deck, at least one work center arranged in the drill deck; a diverter system operatively connectable at least to a riser extending towards the seafloor; a hoisting system adapted for raising or lowering tubular equipment through the work center; wherein the offshore drilling rig includes a first positioning system configured for positioning at least the work center and/or the diverter system and/or a riser tensioning system selectively at a first horizontal position and a second horizontal position, different from the first horizontal position; and wherein the hoisting system is operable to raise or lower tubular equip- (Continued)

ment through the work center when said work center is positioned at said first horizontal position.

21 Claims, 17 Drawing Sheets

Related U.S. Application Data

(60) Provisional application No. 61/787,984, filed on Mar. 15, 2013.

(51) Int. Cl.
*E21B 3/02* (2006.01)
*E21B 7/12* (2006.01)
*E21B 21/00* (2006.01)
*E21B 19/14* (2006.01)
*E21B 19/00* (2006.01)

(52) U.S. Cl.
CPC ..... *E21B 19/084* (2013.01); *E21B 19/143* (2013.01); *E21B 21/001* (2013.01)

(56) References Cited

U.S. PATENT DOCUMENTS

| | | | | |
|---|---|---|---|---|
| 4,423,994 | A | 1/1984 | Schefers et al. | |
| 4,597,447 | A | 7/1986 | Roche et al. | |
| 4,850,439 | A | 7/1989 | Lund | |
| 5,762,279 | A * | 6/1998 | Horton, III | E21B 19/02 254/285 |
| 6,041,865 | A * | 3/2000 | Knapp | E21B 19/002 166/345 |
| 6,926,529 | B1 | 8/2005 | Roodenburg et al. | |
| 9,127,516 | B2 | 9/2015 | Roodenburg | |
| 9,714,546 | B2 * | 7/2017 | Kannegaard | E21B 15/02 |
| 2007/0251725 | A1 | 11/2007 | Banks | |
| 2008/0000685 | A1 * | 1/2008 | Humphreys | E21B 15/02 175/5 |
| 2009/0057011 | A1 | 3/2009 | Petersson et al. | |
| 2010/0071906 | A1 | 3/2010 | Rodrigues | |
| 2010/0147524 | A1 | 6/2010 | Springett et al. | |
| 2011/0017511 | A1 | 1/2011 | Payne | |
| 2011/0247827 | A1 * | 10/2011 | Humphreys | B63B 35/4413 166/345 |
| 2013/0284450 | A1 * | 10/2013 | Roodenburg | E21B 15/02 166/352 |
| 2016/0090794 | A1 * | 3/2016 | Holck | E21B 19/02 166/352 |

FOREIGN PATENT DOCUMENTS

| | | | |
|---|---|---|---|
| WO | 87/02915 | A1 | 5/1987 |
| WO | 99/23348 | A1 | 5/1999 |
| WO | 2004/035985 | A1 | 4/2004 |
| WO | 2007/148977 | A1 | 12/2007 |
| WO | 2008/121071 | A1 | 10/2008 |
| WO | 2012/087119 | A1 | 6/2012 |

OTHER PUBLICATIONS

Written Opinion (PCT/ISA/237) dated Jun. 18, 2015, by the European Patent Office as the International Searching Authority for International Application No. PCT/2014/055312.

* cited by examiner

OFFSHORE DRILLING RIG AND A METHOD OF OPERATING THE SAME

CROSS REFERENCE TO RELATED APPLICATIONS

The present application is a continuation of U.S. patent application Ser. No. 14/777,017, which was filed in the U.S. on Sep. 15, 2015, and which is a national stage of PCT International Application No. PCT/EP2014/055312, filed Mar. 17, 2014, which claims priority of Danish Patent Application No. PA 2013 70604, filed Oct. 22, 2013, which claims the priority of Danish Patent Application No. PA 2013 00303, filed May 20, 2013, and Danish Patent Application No. PA 2013 70604, filed Oct. 22, 2013, and which claims the benefit of U.S. Provisional Patent Application No. 61/787,984, filed Mar. 15, 2013.

TECHNICAL FIELD

The present invention relates to an offshore drilling rig comprising a drill deck where at least one or two work centers are arranged in the drill deck, at least one of the work centers being operable as a primary well center meaning that it is equipped, or can be equipped, for drilling operations using a diverter that can be connected to a mud return conduit capable of conducting drilling mud from the sea floor to the offshore drilling rig.

BACKGROUND

Offshore drilling rigs of this kind are expensive to build and operate, and the continued development of this kind of rigs is therefore focused on providing a rig that will reduce the time of production, meaning that the time for drilling and installing the necessary equipment for e.g. oil production shall be as short as possible preferably without significantly increasing the costs of building and operating the rig.

For this purpose many different types of offshore drilling rigs have been proposed in the past.

On this background it remains desirable to provide an offshore drilling facility that will increase the possibility of operating the rig, even when essential equipment is out of order, e.g. due to maintenance or breakdown.

SUMMARY

Disclosed herein are embodiments of an offshore drilling rig comprising:

- a drill deck;
- a first work center arranged in the drill deck;
- a diverter system operatively connectable to a riser extending towards the seafloor;
- a first hoisting system adapted for raising or lowering tubular equipment through the first work center;

wherein the offshore drilling rig comprises a first positioning system configured for positioning at least the diverter system selectively at a first horizontal position and a second horizontal position, different from the first horizontal position; and wherein the first hoisting system is operable to raise or lower tubular equipment through the first work center and said diverter system at least when said diverter system is positioned at said first horizontal position.

Consequently, drilling operations and/or maintenance and repair operations may be performed with an increased flexibility. Selectively positioning a diverter system at different horizontal positions allows the diverter system to be moved between respective work center positions, e.g. positions under respective work centers or under a displaceable work center, such as under respective hoisting systems of a dual activity rig or otherwise at different operational positions under the drill deck. Alternatively or additionally, the diverter system may be moved between an operational position under a hoisting system and a parking position. For example, a displaceable diverter system may allow a diverter system that is malfunctioning to be replaced by another diverter system. In some embodiments, the diverter system is displaceable between the first and second horizontal positions with the riser connected to it, i.e. without having to disconnect the riser from the diverter system. The diverter system may further be operatively connectable to the first work center at least when said first work center is positioned at said first horizontal position and operatively connectable to the first work center or another work center at least when said first work center is positioned at said second horizontal position.

In some embodiments, the first work center is horizontally displaceable and the first positioning system is further configured for movement of the first work center between the first and the second position; wherein the first positioning system is configured for individual or common movement of the first work center and of the diverter system. Consequently, tubular equipment may be retrieved from a work center in case the hoisting system operating above the first work center is malfunctioning. To this end, the first work center and, optionally, a diverter system operationally connected to the first work center may be moved to a position where it can cooperate with another hoisting system or other pipe handling equipment. Moreover, when the first positioning system is configured for movement of the first work center and the diverter system between the first and the second positions while tubular equipment extends through the first work center, drilling operations may be continued using a second hoisting system, if the first hoisting system fails.

In some embodiments, the drilling rig comprises a riser tensioning system operable to provide tension to said riser; wherein the first positioning system is further configured to position the riser tensioning system selectively at the first horizontal position and the second horizontal position. Hence, in some embodiments, the first positioning system may allow the diverter system and the riser tensioning system to be moved between two work centers. In particular, the diverter system and riser tensioning system may be moved together with a riser connected to the diverter system and riser tensioning system and extending downward towards the seafloor and, optionally, even while connected to a BOP or other equipment at the seabed. Hence, the location of the work center through which drilling operations are performed may be moved horizontally relative to the drill deck without having to disconnect and reestablish the riser. In particular, in some embodiments, the first positioning system is configured for movement of the diverter system and the riser tensioning system between the first and the second positions (e.g. between two stationary work centers) while tubular equipment extends through the diverter system. To this end, the tubular equipment may be hung off in the diverter system, the riser tensioning system or by another suitable device below the drill deck. Alternatively, the first positioning system may be configured for movement of the first work center, the diverter system and the riser tensioning system between the first and the second positions while tubular equipment extends through the first work center and, optionally even extends through a riser suspended by the riser tensioning system. Consequently during a failure of the topdrive or hoisting system that services the primary well center, the primary well center may be displaced and positioned under the second hoisting system so as to allow continuation of the drilling operation or at least retrieval of tubular equipment. The tubular equipment extending through the displaceable work center may e.g. be hung off in the displaceable rotary table or in a suitable tool such as a casing spider, a riser spider and gimbal, or similar device, which may rest on top of the displaceable rotary table or be attached to the displaceable rotary table.

In some embodiments, the drilling rig further comprises a second work center arranged in the drill deck horizontally spaced apart from the first work center; and a second hoisting system adapted for raising or lowering tubular equipment through at least the second work center. Hence, some embodiments of the drilling rig comprise two work centers arranged in the drill deck horizontally spaced apart from each other, and where at least one of the work centers is operable as a primary well center. Consequently, the drilling rig may perform multiple drilling operations concurrently.

As will be described below, a displaceable work center and, optionally, diverter system may also be used to allow multiple hoisting systems to operate above the same work center simultaneously or individually so that, when both hoisting systems are operative, it will be possible to use both hoisting systems over the same work center or to use one hoisting system over a work center and, at the same time, operating the other hoisting system over the primary well center, or another work center.

Generally, positioning equipment, such as a work center, a diverter system, a riser tensioning system, a load carrier, etc., at a horizontal position is intended to refer to a positioning such that the equipment can be operatively connected to, or otherwise engage, tubular equipment that is suspended or otherwise located in upright orientation with its longitudinal axis at said horizontal position. The term work center refers to a hole in the drill deck through which the drilling rig is configured to lower tubular equipment towards the seabed and, in particular, through which tubular equipment may be lowered all the way to the seabed. A work center thus defines a downward passage extending through the drill deck through which tubular equipment may be lowered toward the seabed or even to the seabed. In this respect the term work center covers e.g. a well center, a mousehole, a rathole or a standbuilding foxhole, with or without different tools inserted into or supported from it, such as powerslips or other equipment.

A work center through which the drilling rig is configured to lower tubulars all the way to the seabed and/or through which the drilling rig can perform drilling into the seabed is often referred to as a well center. A well center is sometimes also referred to as a drilling center. It will be appreciated that the drill deck may comprise additional holes such as foxholes and mouse holes that may e.g. be used for building stands of tubulars but through which the drilling rig cannot lower tubulars to the seabed and/or through which the drilling rig cannot perform drilling into the seabed e.g. by lacking a system arranged to rotate a drill string with sufficient force such as a top drive or a rotary table. In some embodiments, a well center comprises a rotary table or a similar device allowing a drill string to be suspended by, or hung off in, the well center; to this end, a well center may comprise power slips or other devices operable to engage tubular equipment and to support the weight of the tubular equipment and, in particular, a string of tubular equipment extending to the seabed, so as to prevent the tubular equipment from descending through the well center. A displaceable well center may comprise a displaceable rotary table or a similar displaceable element comprising a hole and defining a downward passage.

A primary well center is in this relation a well center being operatively connectable to and adapted for drilling operations through a riser. Generally, the term riser refers to a mud return conduit such as a marine riser or a high pressure riser. A marine riser is typically used with floating drilling rigs while a high pressure riser (also sometime referred to as a conductor pipe) is typically used on stationary offshore drilling rigs such as jack-ups. In this relation a primary well center is therefore differentiated from other work centers by having a diverter system including a diverter housing arranged below so that drill string passed through the primary well center extends through said diverter housing arranged for diverting e.g. blow outs to one side of the offshore drilling rig. Moreover, the drilling rig comprises a hoisting system, top drive and/or other equipment configured to operate through the primary well center and to perform drilling operations in the seabed. In some embodiments, the drilling rig may comprise a single primary well center or two or even more primary well centers. In addition to one or more primary well centers, the drilling rig may comprise additional work centers and or other additional holes in the drill deck through which the drilling rig cannot progress a drill string through a riser.

In some embodiments, the or each displaceable work center is a displaceable well center or even a displaceable primary well center. In some embodiments, the drilling rig may comprise two or more work centers that are each operable as primary well centers, e.g. by selectively positioning a displaceable diverter system below one of the work centers. Hence, by moving the diverter system and, optionally, a riser tensioning system between two work centers, the primary well center is effectively displaced between the positions of the two work centers.

An offshore drilling rig may be any vessel that includes machinery and equipment used for drilling a well. The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively the offshore rig may be of a different type, such as bottom-supported drilling rig, e.g. a jack-up drilling rig, or a drill ship or other type of drilling vessel. Tubular elements are often simply referred to as "tubulars".

The term tubular equipment is intended to refer to tubular equipment that is advanced through the well center towards the sea floor during one or more stages of the drilling operation. The tubular equipment may be selected from drill pipes and/or other tubular elements of the drill string, risers, liners and casings. Examples of tubular elements of the drill string include drill pipes, drill collars, etc.

For the purpose of this description, the term drill deck is intended to refer to the deck of an operating platform of an offshore drilling rig immediately above which joints of tubulars are assembled to form the drill string which is advanced through the well center towards the seabed. Hence the drill deck is the primary work location for the rig crew and/or machines performing similar functions, such as iron roughnecks. The drill deck normally comprises a rotary table for supporting and/or rotating a drill string during drilling operations. For the purpose of the present description, the term drill deck includes the drill floor located directly under/next to the mast and surrounding the well center as well as deck areas on the same level as, and connected with, the drill floor area by uninterrupted floor area on the same level, i.e. the floor area where human operators and movable equipment such as forklifts, equipment moved on skid-beams, etc. can move around and to/from the well center; in some embodiments without having to climb/descend stairs or other elevations. The drill deck is typically the floor of a platform, e.g. the lowest platform, above the diverter system.

For the purpose of the present description, the term drilling support structure is intended to refer to any construction extending upwardly relative to the drill deck and being equipped for supporting a hoisting system for hoisting and lowering tubulars (such as drill strings, casings and/or risers) towards the seabed so that drilling into the seabed can be performed. The drilling support structure may extend from the drill deck or from a deck different to the drill deck. The hoisting system is in this relation any system that provides a lifting capacity above one or more of the work centers arranged in the drill deck. This may, in some embodiments, be in the form of a hydraulic hoisting system comprising upwardly extending cylinders for supporting the load to be hoisted or lowered, typically via cable sheaves mounted on top of the cylinders or, alternatively, it may be in the form of a conventional draw works system. Examples of a drilling support structure includes a derrick structure which is typically applied to support a draw works hoisting system and a mast structure which is typically applied to support a cylinder hoisting system. In embodiments where the drilling support structure is located adjacent to a well center, dual-activity structures may be arranged in a number of different configurations, including a face-to-face configuration where the well centers are located horizontally between the respective support structures or in a side-by-side configuration where the drilling support structure are located on one side of an axis connecting the well centers.

The diverter system may be operable to divert wellbore fluids, such as drill mud from the riser, away from the drill deck. To this end, the diverter system is connectable to a riser extending towards the seafloor. The diverter system may comprise a diverter housing from which outlet ports extend. The diverter system may comprise further diverter components such as valves and/or an annular sealing member that seals off the annulus around the pipe, etc. During operation, the diverter system is positioned below a well center, e.g. below the rotary table defining the well center. The diverter system may directly or indirectly be connected to the rotary table.

The riser tensioning system may comprise any device configured to reduce or even minimize variations of the upward force on the riser e.g. due to the movement of the floating drill vessel. The riser may be a marine riser or a high pressure riser. As the bottom end of the marine riser is connected to the wellhead on the seabed, the riser tensioning system is typically operable to manage the differential movements between the riser and the rig. Examples of riser tensioning systems may comprise hydraulic actuated cylinders with wire sheaves, direct acting riser tensioners where hydraulic cylinders are directly attached to a tension ring surrounding the riser, or active electrical motors used for compensation purposes.

The first positioning system may comprise one or more guides such as tracks, beams or the like for guiding the displacement of equipment between the first and second positions. The first positioning system may further comprise one or more drive systems e.g. including one or more actuators, motors and/or the like for driving the displacement of the displaceable equipment. It will be appreciated that the positioning system may be operable to selectively position the first work center and/or the diverter system and/or the riser tensioning system at more than two horizontal positions. It will further be appreciated that the positioning system may comprise releasable locking members for locking the first work center and/or the diverter system and/or the riser tensioning system at the first and/or second horizontal positions so as to prevent inadvertent displacement.

In some embodiments, at least the first work center and/or the diverter system and/or the riser tensioning system is mounted on a guide member, such as a track or beam, extending between the first and second horizontal positions. Similarly, the riser tensioning system may comprise one or more riser tensioners arranged below the drill deck, where the riser tensioners are mounted on a linear riser tensioner track being arranged so that the riser tensioner can be selectively positioned below a selected work center. In some embodiments each of the displaceable equipment may be mounted on a separate set of guides while, in other embodiments, two or more of the displaceable devices may be mounted on a common set of guides.

In some embodiments, the first positioning system is configured to selectively position the diverter system and/or the first work center at the first and the second horizontal positions while the second work center is positioned at a third horizontal position, different from the first and second horizontal positions. In particular, the drilling rig may comprise a second work center which may be stationary at the third horizontal position or displaceable between the first and the third positions, and which may be operated in connection with the second hoisting systems; the drilling rig may further comprise a first, displaceable work center which may be displaceable between the first and second positions, e.g. at respective distances from the second work center. Such a displacement may allow the two hoisting systems to operate above the respective work centers independently and at a sufficient distance from each other. When the first work center is moved to a first position, closer to the second work center, the second hoisting system may be operable to operate above the thus displaced first work center, either alone or together with the first hoisting system that normally operates above the displaceable first work center. The second and third positions may be peripheral positions and the first position may be a central position located between the two peripheral positions. In particular, the first position may be located on a straight line connecting the second and third positions, e.g. in a center between the second and third positions. In some embodiments the second and third positions are spaced apart more than 8 m, e.g. more than 10 m, e.g. at least 12 m, e.g. at least 14 m, while the first position may be spaced apart from each of the second and third positions by less than 8 m, e.g. no more than 6 m.

In particular, in some embodiments, the first and second hoisting systems are operable to separately or together raise or lower tubular equipment through said first, displaceable work center when the displaceable work center is positioned at said first horizontal position. To this end, in some embodiments, the first hoisting system is configured to raise or lower a first load carrier, and the second hoisting system is adapted to raise or lower a second load carrier; and wherein the drilling rig comprises a second positioning system configured for positioning at least a displaceable one of the first and second load carriers selectively at the first horizontal position and the second horizontal position. As described in relation to the first positioning system, the second positioning system may comprise one or more guide members and/or one or more drive system and/or one or more releasable locking members.

While a displaceable work center and/or diverter system and/or riser tensioning system may be used with hoisting systems whose load carriers are horizontally stationary and operable above a fixed horizontal position, some embodiments of the drilling rig disclosed herein allow horizontal displacement of the work center as well as displacement of the load carrier of a hoisting system, thus providing even higher operational flexibility.

Each hoisting system may comprise a lifting cable hanging over at least one cable crown being supported by the drilling support structure and each being adapted for raising or lowering a load carrier, and the second positioning system may be adapted for selectively positioning one or each load carrier in a number of different horizontal positions. The different horizontal positions may comprise the first horizontal position, e.g. above a primary well center, and a second horizontal position different from the first horizontal position, wherein the positioning system is adapted for positioning one or each cable crown so as to move at least the displaceable load carrier above said first horizontal position or above said second horizontal position.

In some embodiments the offshore drilling rig comprises at least one top drive and the second positioning system is adapted for selectively positioning the top drive at a first horizontal position and at a second horizontal position, different from the first position, where e.g. the top drive in the first position may be positioned above a primary well center.

The offshore drilling rig may further comprise a connecting tool having two opposite ends, each being adapted for being directly or indirectly connected to one of the load carriers, and where the connecting tool has an intermediate load carrier arranged between said two opposite ends and being adapted for carrying a load. Thereby the two hoisting systems may be used simultaneously for providing the combined lifting capacity of each hoisting system in order to lift a load otherwise too heavy for one hoisting system e.g. out of the primary well center.

The hoisting systems may in this relation be any suitable hoisting system such as based on a draw works or a hydraulic cylinder configuration. In this relation the term cable crown covers any device supported by the drilling support structure and being adapted for supporting one or more lifting cables hanging below the drilling support structure beneath the cable crown. This may be in the form of a single cable sheave adapted for supporting one or more cables, or a cluster of cable sheaves being independently rotatable so as to constitute a crown block or a cable sheave cluster e.g. supporting a travelling block beneath the crown block. Furthermore the term load carrier in this relation means any device adapted for being carried by the hoisting system, and allowing a load to be connected to the load carrier. Examples of load carriers may be a load carrying hook, yoke, shackle or a travelling block. In some embodiments, the drilling rig comprises one or more top drives, each suspended from a respective load carrier. The tubular string may then be connected to the top drive allowing the drill string to be rotated by the top drive while being carried by the hoisting system. In some embodiments, the drilling rig comprises two top drives, each suspended from a respective one of the first and second hoisting systems.

In one embodiment, each of the load carriers is connected to a lifting cable hanging from a cable crown (such as a cable sheave cluster or a crown block) supported in by the drilling support structure, and the second positioning system is adapted for shifting at least one of or each of the cable crown to and from a first and a second horizontal position relative to that cable crown where the load carrier is positioned right above a selected one of the work centers. The position of the cable crown is measured by the position of the load carrier. Also, by each of the cable crowns having at least two positions several configurations are possible including but not limited to the configurations where the rig has two work centers or three work centers as discussed below where the cable crowns have a common position in the middle and each have a second position to the side. In a configuration with two work centers, one or both cable crowns may be arranged to be positioned over both work centers so that one can replace the other for redundancy and/or the load carriers may be arranged to lift together through one of the work centers. In some embodiments, the second positioning system is configured to position one or each cable crown and one or respective top drives suspended from the lifting cable.

Furthermore, the second positioning system may advantageously comprise a retractable dolly arranged for each top drive, and the retractable dolly being adapted to connect the top drive to a vertically extending track mounted on the drilling support structure, and to position the top drive in the first and the second horizontal position above e.g. two different work centers and being adapted for positioning the top drive a distance from the track, so that it is positioned right above one of the work centers. In order to enable this function in practice it will be recognized that the retractable dolly may be adapted to reach a top drive at a substantial horizontal distance from the vertically extending track, even where such a distance exceeds 4 or even 5 meters, such as exceeds 6 or even 7 meters, such as exceeds 8 or even 9 meters, such as exceeds 10 or even 11 meters, such as exceeds 12 or even 13 meters.

In order to reduce the horizontally induced load on the retractable dolly it is in this relation preferred that the cable crown carrying a top drive, and the retractable dolly connecting the same top drive to said vertically extending track are adapted to keep the lifting cable between the cable crown and the top drive substantially vertical.

The drilling rig may further comprise a connecting tool, such as a connecting yoke, having two opposite ends each being adapted for directly or indirectly connecting it to one of the load carriers, so that the connecting tool can be carried by two different load carriers, and where the connecting tool has an intermediate load carrier being arranged between said two opposite ends and being adapted for carrying a load. In this way, it is possible to mount the connecting tool so that it is hanging below and between two load carriers, and thereby it is possible to provide a lifting power being higher than the lifting power of each of the hoisting systems by using both hoisting systems to lift the same load via the connecting tool.

In this relation, the second positioning system may advantageously further be adapted for shifting each of the two cable crowns to a position right next to the first position, and so that the two load carriers are positioned on opposite sides of the first position.

In some embodiments, one or each of the two work centers is mounted in a substantially horizontal track in or below the drill deck, and the drilling rig comprises a work center positioning system adapted for selectively moving at least one of or each of the work centers in the horizontal track to the first or the second position in the drill deck.

In this relation the horizontal track may preferably be linear at least along a part of it, and the diverter system may comprise a diverter over board tube having a first end being connected to the diverter housing and the other end being supported and fixed with respect to the drill deck and having at least one telescopic section between the first and the second end, the telescopic section extending parallel to the linear part of the horizontal track in the drill deck. Thereby the diverter over board tube, which may be directing well fluids under high pressure from the diverter and over board, is relatively easy to keep tight during drilling operations e.g. by using a hydraulic, pneumatic or mechanical packer to tighten and seal the telescopic section during drilling operations.

The drilling rig may advantageously further comprise at least one riser tensioning arrangement below the drill deck, and where the riser tensioners are mounted on linear tracks for repositioning, and in parallel to the horizontal track in the drill deck, so that the riser tensioners can be positioned below either of the work centers and/or below either of the first or second positions.

In a further preferred embodiment, two work centers may both be operable as primary well centers comprising a rotary table and a diverter system arranged in the drill deck.

In yet a further preferred embodiment, the second positioning system is adapted for shifting each of the cable crowns along a line being parallel to the linear part of the horizontal track in or below the drill deck.

In the context of this description the terms of moving, positioning, skidding shifting and so on is meant to include the process of displacing a component or part from one position to another, but also the necessary means for holding or fixing the component or part at a selected position during operation of the drilling rig.

The present disclosure relates to different aspects including the drilling rig described above and in the following, corresponding methods, apparatus, and/or product means, each yielding one or more of the benefits and advantages described in connection with the first mentioned aspect, and each having one or more embodiments with all or just the additional features corresponding to the embodiments described in connection with the first mentioned aspect and/or disclosed in the appended claims.

In particular, in some situations it may be desirable to provide a positioning system for the riser tensioning system alone or for the riser tensioning system together with the diverter system. For example, in embodiments of a drilling rig comprising two work centers that are operable as primary well centers, each being equipped (or at least being adapted for being equipped) with a diverter system, it may be desirable to move a riser tensioning system that is operatively connected to one of the primary well centers to the other primary well center, e.g. in situations of a failure of the top drive operating above one of the primary well centers. Such a movement of the riser tensioning system may even be performed with a riser being suspended from the riser tensioning system. To this end, when the riser tensioning system is moved between two stationary work centers, each operationally connected to a diverter system, the riser string may be disconnected from the diverter system under one of the work centers while still being suspended by the riser tensioning system. The riser tensioning system at the riser suspended from it may then be moved to the other work center and the riser may be reconnected to the diverter system of the other work center. Similarly, the riser tensioning system and the riser may be moved from one to another work center together with a diverter system and reconnected to said another work center. Consequently, drilling operations through an established riser may be continued through the other primary well center. A displaceable riser tensioning system and/or displaceable diverter system may be installed on an existing drilling rig with two stationary rotary tables.

Accordingly, according to one aspect, disclosed herein are embodiments of an offshore drilling rig comprising:

- a drill deck;
- a first work center and a second work center arranged in the drill deck horizontally spaced apart from each other, and where at least one of the work centers is operable as a primary well center;
- a diverter system operatively connectable to a riser extending towards the seafloor;
- a riser tensioning system operable to provide tension to the riser;
- a first hoisting system adapted for raising or lowering tubular equipment through at least the first work center;
- a second hoisting system adapted for raising or lowering tubular equipment through at least the second work center;

wherein the offshore drilling rig comprises a first positioning system adapted for positioning at least the riser tensioning system selectively at a first horizontal position and a second horizontal position different from the first horizontal position, wherein the riser tensioning system, when positioned at the first horizontal position, is operatively connectable to a riser extending towards the seafloor below the first work center; and wherein the riser tensioning system, when positioned at the second horizontal position, is operatively connectable to a riser extending towards the seafloor below the second work center.

According to another aspect, it may be desirable to provide a positioning system for a work center, such as a well center, alone so as to allow displacement of a work center, e.g. a rotary table, relative to the drill deck without also necessarily displacing a diverter system or riser tensioning system. Accordingly, according to one aspect, disclosed herein are embodiments of an offshore drilling rig comprising:

- a drill deck;
- a first work center arranged in the drill deck;
- a diverter system operatively connectable to a riser extending towards the seafloor;
- a first hoisting system adapted for raising or lowering tubular equipment through the first work center;

wherein the offshore drilling rig comprises a first positioning system configured for positioning the first work center selectively at a first horizontal position and a second horizontal position, different from the first horizontal position; and wherein the first hoisting system is operable to raise or lower tubular equipment through the first work center at least when said first work center is positioned at said first horizontal position.

According to yet another aspect, disclosed herein are embodiments of a method of performing drilling operations by using an offshore drilling rig, the drilling rig comprising:

- a drill deck;
- at least two work centers arranged in the drill deck horizontally spaced apart from each other, at least one of the work centers being operable as a primary well center;
- a first hoisting system adapted for raising or lowering tubular equipment through at least one of the work centers;

a second hoisting system adapted for raising or lowering tubular equipment through at least one of the work centers;

and wherein the method comprises:

positioning a displaceable one of the work centers at a first horizontal position;

performing drilling operations through the displaceable work center by means of at least the first hoisting system;

moving the displaceable work center from the first to a second horizontal position, different from the first horizontal position;

continuing drilling operations through the displaceable work center by means of at least the second hoisting system.

Consequently, an increased flexibility and/or redundancy of operation is provided, even in situations of failure of a hoisting system.

According to yet another aspect, disclosed herein are embodiments of a method of performing drilling operations by using an offshore drilling rig, the drilling rig comprising:

a drill deck;

a first work center and a second work center arranged in the drill deck, horizontally spaced apart from each other, and where at least one of the work centers is operable as a primary well center;

a riser tensioning system;

a first hoisting system adapted for raising or lowering tubular equipment through at least one of the first and second work centers;

a second hoisting system adapted for raising or lowering tubular equipment through at least one of the first and second work centers;

and wherein the method comprises:

positioning the riser tensioning system at a first horizontal position wherein the riser tensioning system, when positioned at the first horizontal position, is operatively connectable to a riser extending towards the seafloor below the first work center;

performing drilling operations through the first work center by means of at least the first hoisting system;

moving the riser tensioning system from the first to a second horizontal position, different from the first horizontal position, wherein the riser tensioning system, when positioned at the second horizontal position, is operatively connectable to a riser extending towards the seafloor below the second work center;

continuing drilling operations through the second work center by means of at least the second hoisting system.

Consequently, even existing drilling rigs having stationary work centers may relatively easily be modified so as to provide increased flexibility and/or redundancy of operation. The riser tensioning system may be moved together with or separately from the diverter system. For example, a marine riser connected to the riser tensioning system may be disconnected from the diverter system before the riser tensioning system with the marine riser is moved to a second horizontal position. At the second horizontal position, the marine riser may be reconnected to a different diverter system or to the previous diverter system that has been moved separately.

BRIEF DESCRIPTION OF THE DRAWINGS

In the following one or more embodiments of the invention will be described in more detail and with reference to the drawing, where:

FIGS. 10-18 illustrate another embodiment of an offshore drilling rig, wherein FIG. 10 shows a side view of the drilling rig, FIGS. 11-14 show 3D views of parts of the drilling rig from different viewpoints, FIGS. 15-16 show horizontal cross-sectional views of the drilling rig, and FIGS. 17-18 show lateral cross sections of the drilling rig.

DESCRIPTION OF EXEMPLARY EMBODIMENTS

Figure 1A:
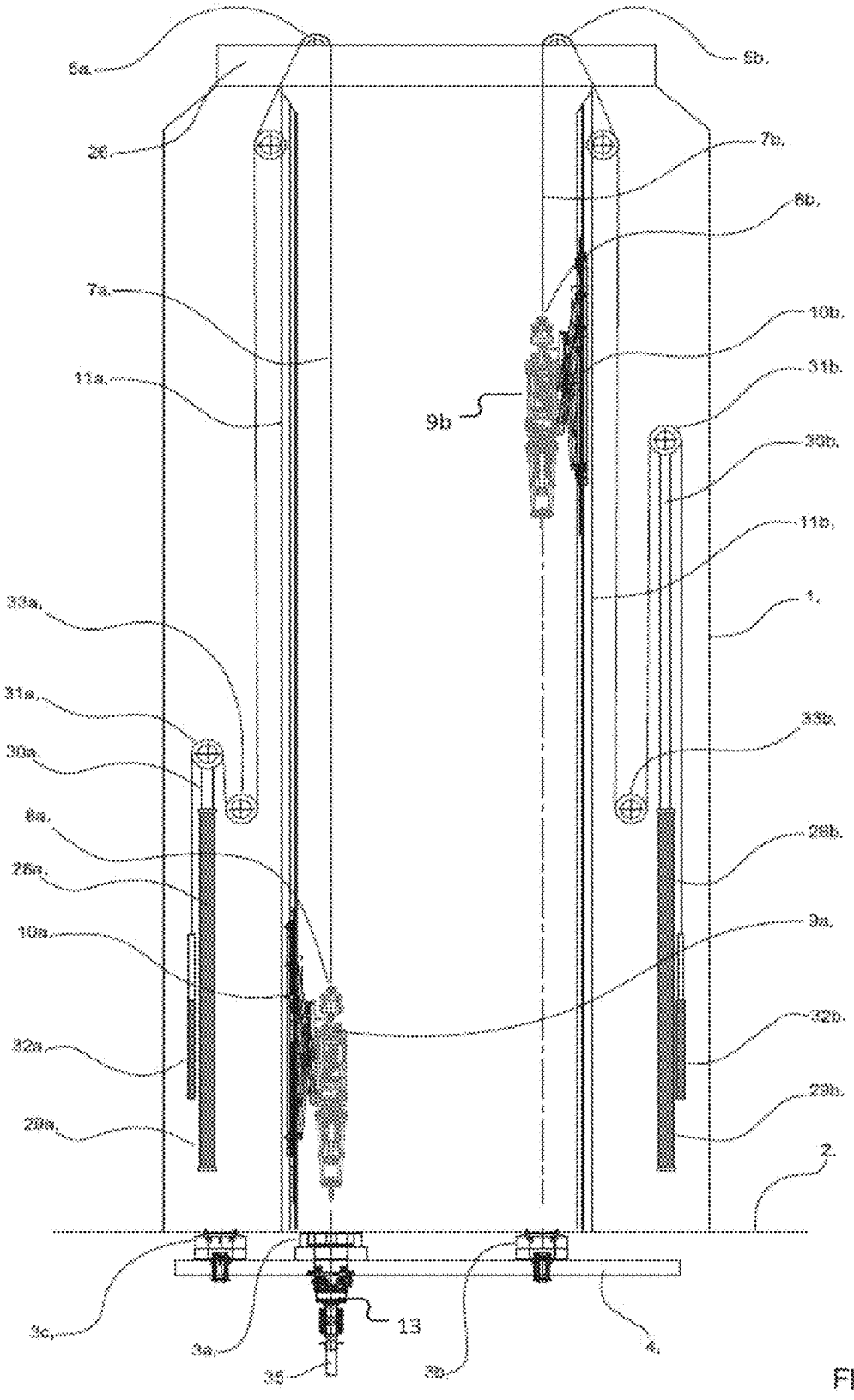
FIGS. 1*a* and 1*b* are concept drawings showing two different operational situations of a dual activity drilling facility seen from one side, incorporating full redundancy for the intended drilling operation by incorporating skidding well centers/work centers in the drill deck.

FIGS. 1*a*, 1*b*, 2*a*, 2*b* and 4 all show a drilling support structure 1 arranged above a drill deck 2 and three work centers 3*a*, 3*b* and 3*c*, where one is in the form of a primary well center 3*a* being equipped with a diverter housing 13. The three work centers 3*a*, 3*b* and 3*c* are supported on individual skidbases on tracks 4 arranged in or below the drill deck 2, and the drilling support structure 1 carries two cable crowns 5*a* and 5*b*, in FIGS. 1*a*, 1*b*, 2*a*, 2*b* and 4 in the form of a crown sheave cluster, being skidably arranged on the top of the drilling support structure 1 on separate tracks 26. Generally, a skidable arrangement allows the displacement, in particular horizontal displacement, e.g. guided by tracks or similar guide means.

From each of the crown sheave clusters 5*a* and 5*b* lifting cables 7*a* and 7*b* are running down and connecting to a load carrier 8*a* and 8*b* each carrying a top drive 9*a* and 9*b* at the end of the lifting cables 7*a* and 7*b*. Each of the top drives is connected via a retractable dolly 10*a* and 10*b* to a vertical track 11*a* and 11*b* arranged at the drilling support structure 1. The retractable dollies 10*a* and 10*b* are each adapted so that they can position and keep the top drives in different positions above the work centers 3*a*, 3*b*, 3*c* in the drilling deck 2.

In the example of FIGS. 1*a*, 1*b*, 2*a*, 2*b*, and 4, all three work centers are displaceable. In particular, the primary well center 3*a* can be positioned in three horizontal positions: a central position and two peripheral positions on respective sides of the central position. The other work centers 3*b,c* may be positioned on respective peripheral positions and on respective parking positions located further away from the central position so as to allow the primary well center to be positioned at the corresponding peripheral position. The retractable dollies 10*a* and 10*b* are each adapted such that each top drive can be positioned above the central position and a respective one of the peripheral positions. It will be appreciated that, in alternative embodiments, the drilling rig may comprise only two work centers, e.g. work centers 3*a* and 3*b*, where the work center 3*b* is positioned at one of the peripheral positions while the primary well center 3*a* may be positioned at the central position and at the other peripheral position not occupied by the well center 3*b*. In such an alternative embodiment, the well center 3*b* may be stationary or displaceable, e.g. so as to allow the primary well center 3*a* to be moved to each of the peripheral positions.

In the embodiment shown on FIGS. 1*a*, 1*b*, 2*a*, 2*b*, and 4 each hoisting system has a linear actuator in the form of a hydraulic cylinder 28*a*, 28*b*, having its lowermost end 29*a*, 29*b* fixed with respect to the drill deck 2 and an upper, travelling end 30*a*, 30*b* with a cable sheave 31*a*, 31*b*. At least one lifting cable 7*a*, 7*b* has one end extending from another hydraulic cylinder 32*a*, 32*b* arranged for compensating heave during e.g. drilling operation, and over the travelling cable sheave 31*a*, 31*b* and further below a second cable sheave 33*a*, 33*b* being fixed with respect to the drilling support structure 1, and thereafter over the crown sheave cluster 5*a*, 5*b*, skidably mounted on the drilling support structure 1 on a track 26. In these figures only a single lifting cable is shown for each hoisting system, but in practice, in order to provide significant lifting capacity as well as redundancy in case one cable breaks, multiple mutually parallel lifting cables extending along with the lifting cables 7*a*, 7*b* are typically used.

Figure 1B:
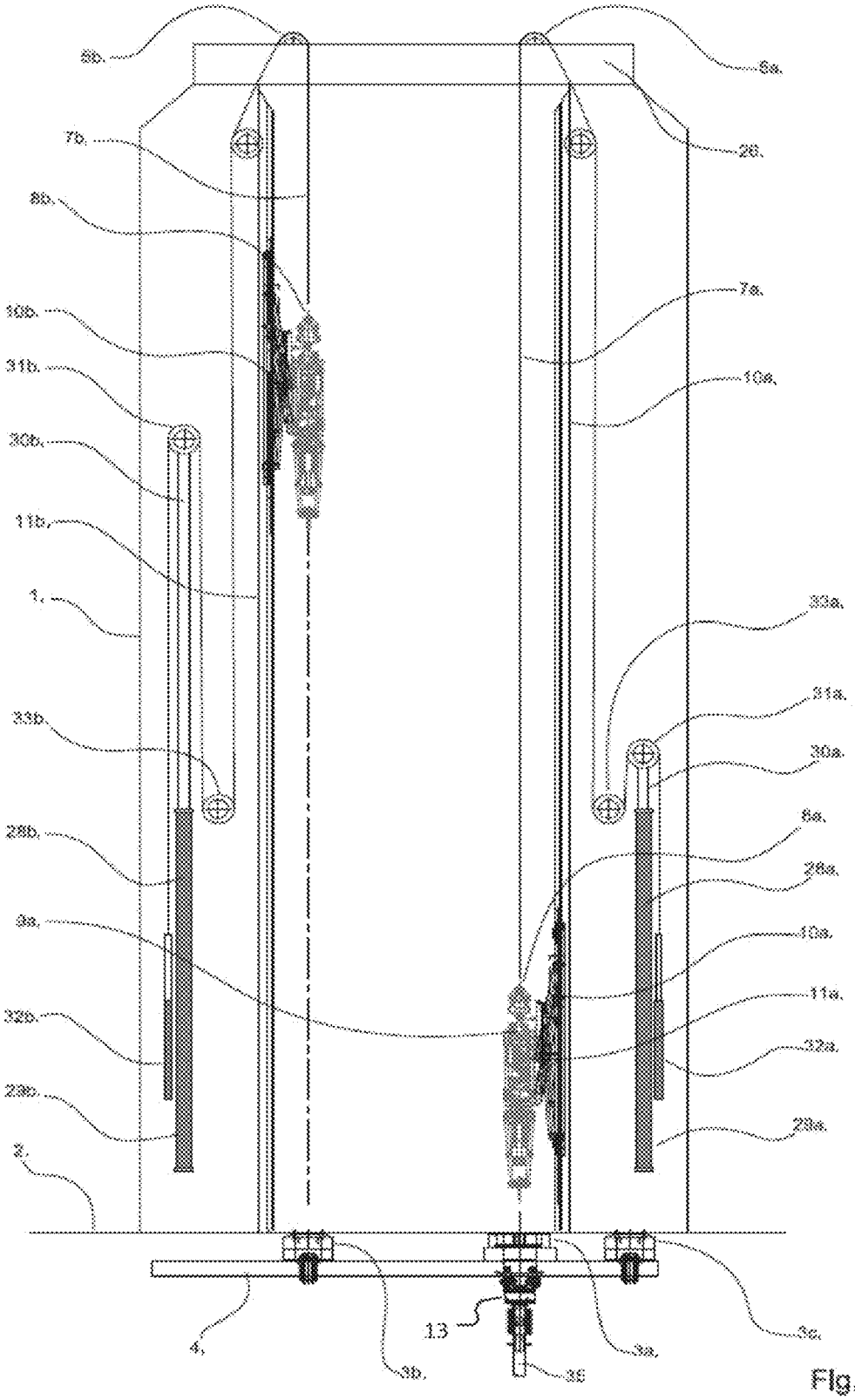
Figure 2A:
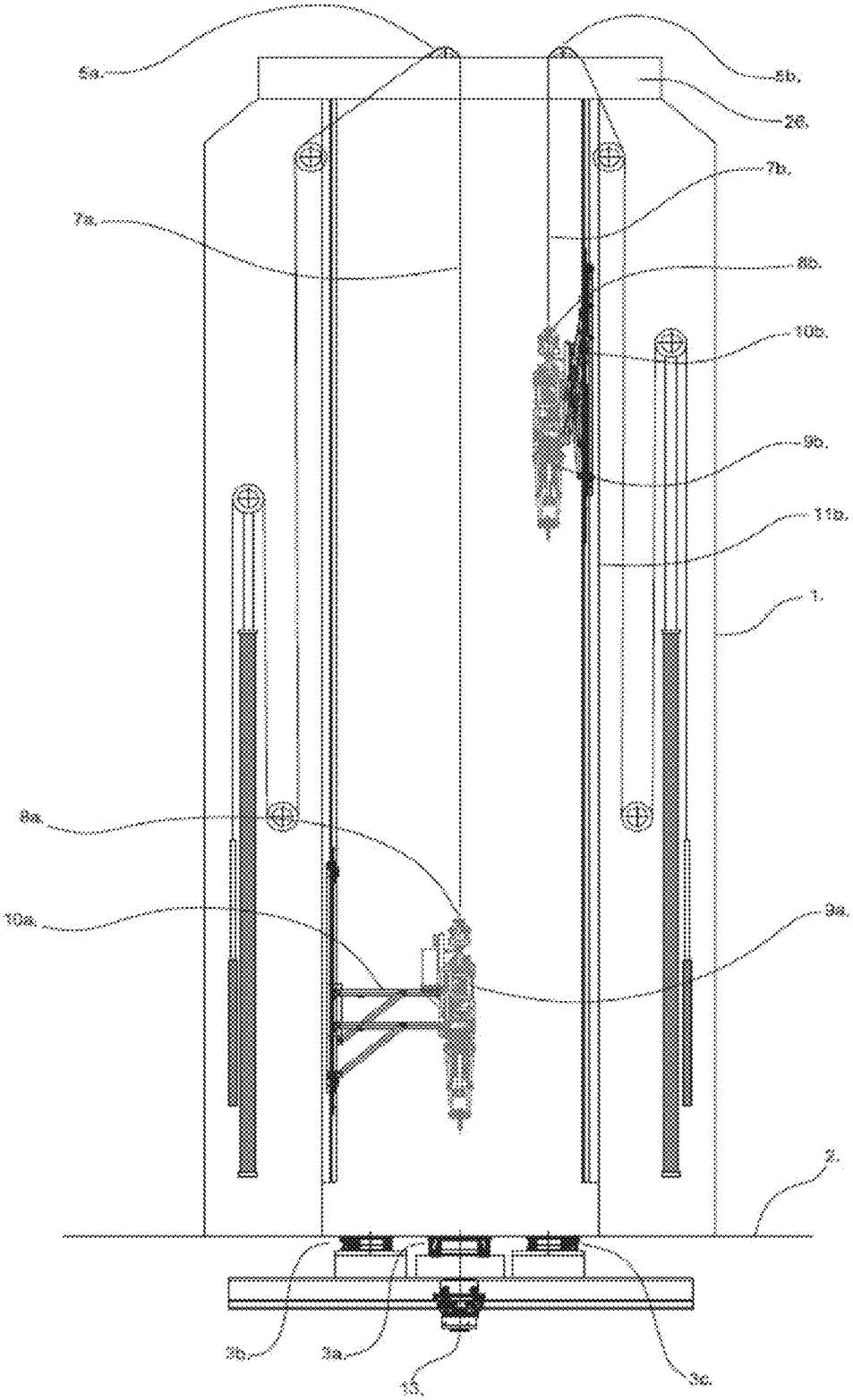
FIGS. 2*a* and 2*b* are concept drawings showing two different operational situations of a cyclic operating hoisting system within the same drilling facility seen from one side, enabling both hoisting systems to work over the same work center individually or in turn for providing fast tripping of drill pipe, casing running or riser- and BOP running/retrieval operation.
Figure 2B:
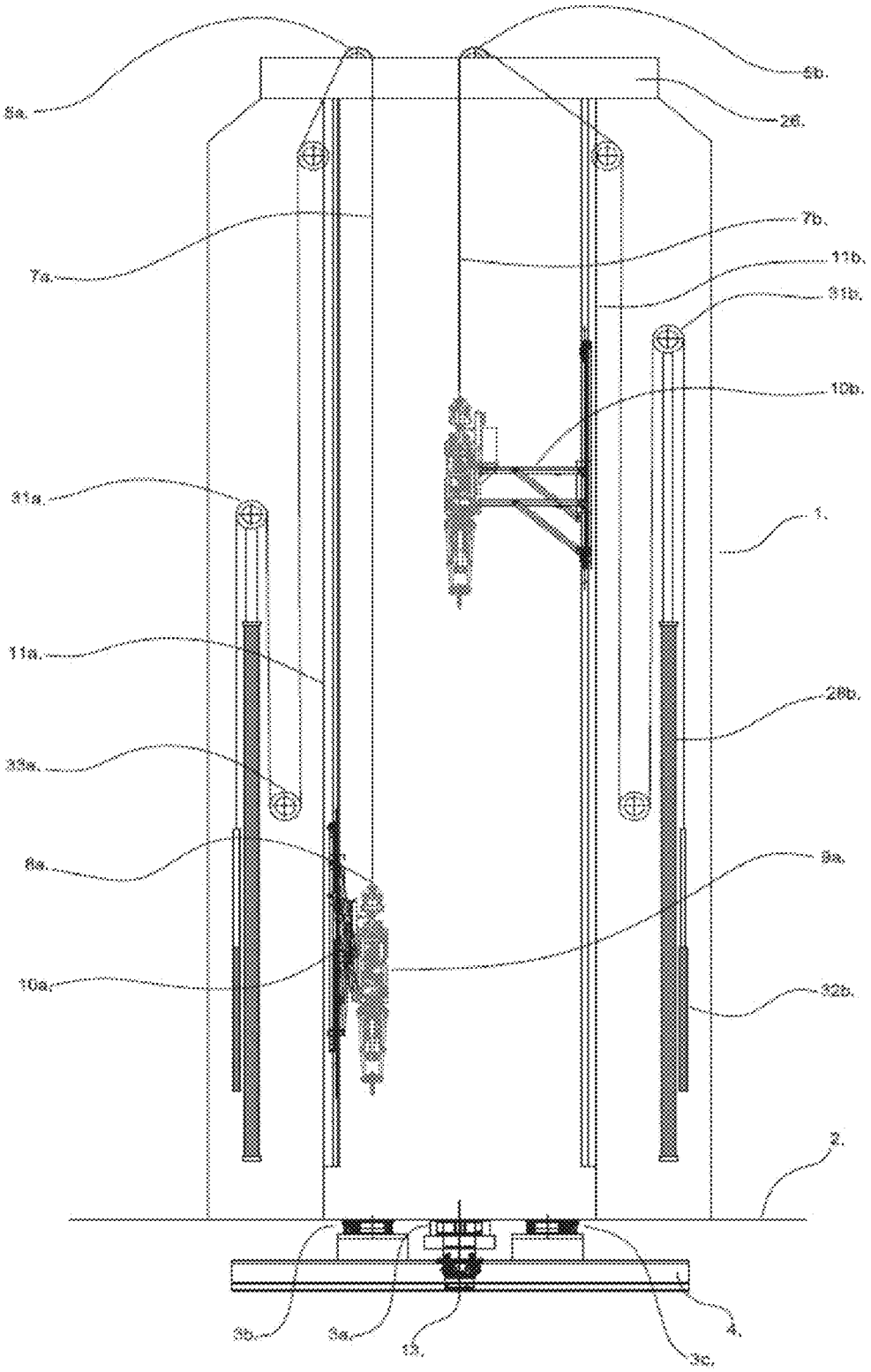
Figure 3:
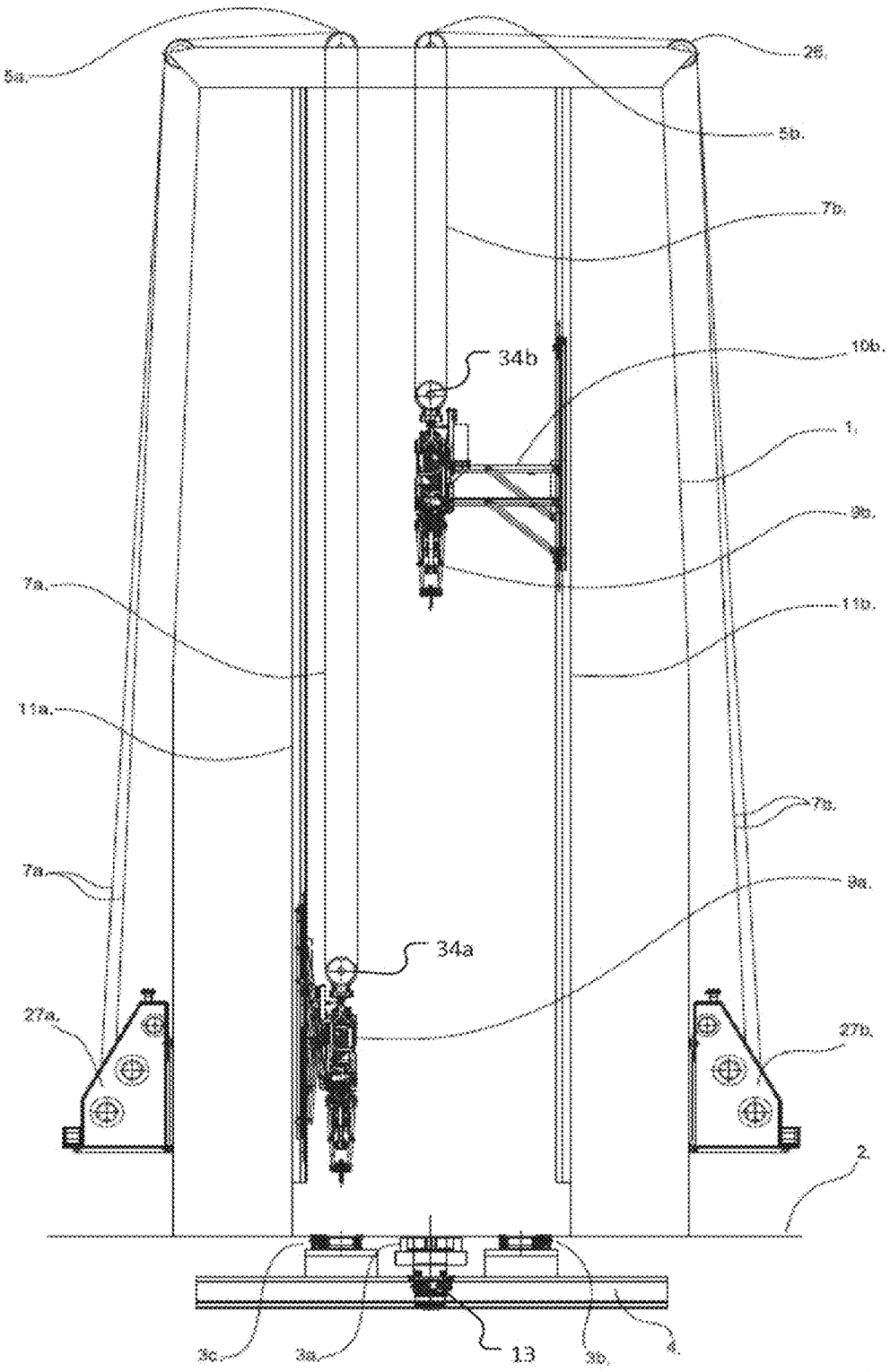
FIG. 3 is a concept drawing showing an embodiment of the drilling rig disclosed herein, where each hoisting system comprises a cable winch.

FIG. 3 shows a drilling rig similar to the drilling rig of FIGS. 1*a*, 1*b*, 2*a*, 2*b* and 4, but comprising a different type of hoisting system. In particular, the drilling support structure 1 shown on FIG. 3 has a hoisting system with two cable crowns 5*a*, 5*b* each in the form of a crown block being connected to a travelling block 34*a*, 34*b* via multiple cable loops hanging down from the crown block 5*a*, 5*b*, In this embodiment each travelling block is carrying a topdrive 9*a*, 9*b*. In this embodiment a single lifting cable 7*a*, 7*b* is providing the multiple cable loops, and thereby the necessary cable lifting capacity of the hoisting system, and therefore, in order to provide the necessary travelling length of the travelling block, a cable winch 27*a*, 27*b* is arranged for each hoisting system. As in the previous embodiments, the drilling rig of FIG. 3 comprises three displaceable work centers. However, as discussed in connection with the previous embodiment, the drilling rig of FIG. 3 may alternatively be provided with only two work centers, one or both of which may be displaceable.

The skilled person will, however, appreciate that the mere combination of the skidable crown sheave clusters 5*a*, 5*b* shown on FIGS. 1*a*, 1*b*, 2*a*, 2*b* and 4 and the linear actuators 28, disregarding other features of the present invention, mutatis mutandis, provides both an efficient and safe lifting capacity, because each hoisting system may comprise multiple lifting cables 7*a*, 7*b* extending parallel to each other in order to carry the same load carrier 8*a*, 8*b* and the same top drive 9*a*, 9*b*.

Figure 4:
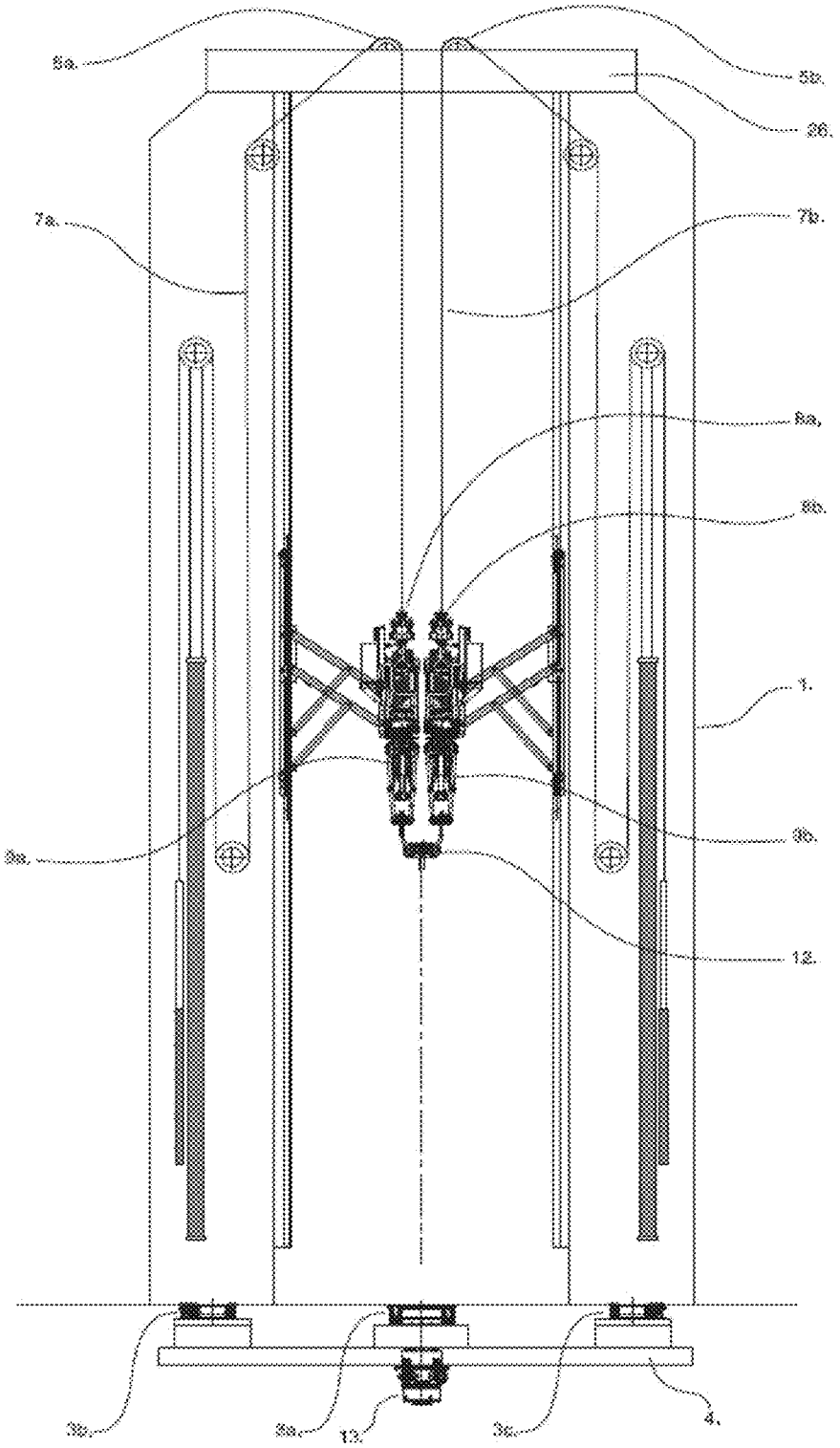
FIG. 4 is a concept drawing showing an operational mode where the two hoisting systems are operated synchronously within the same drilling facility seen from one side, enabling both hoisting systems to work over the same work center in sync for providing a combined lifting capacity in the one work center.
Figure 5:
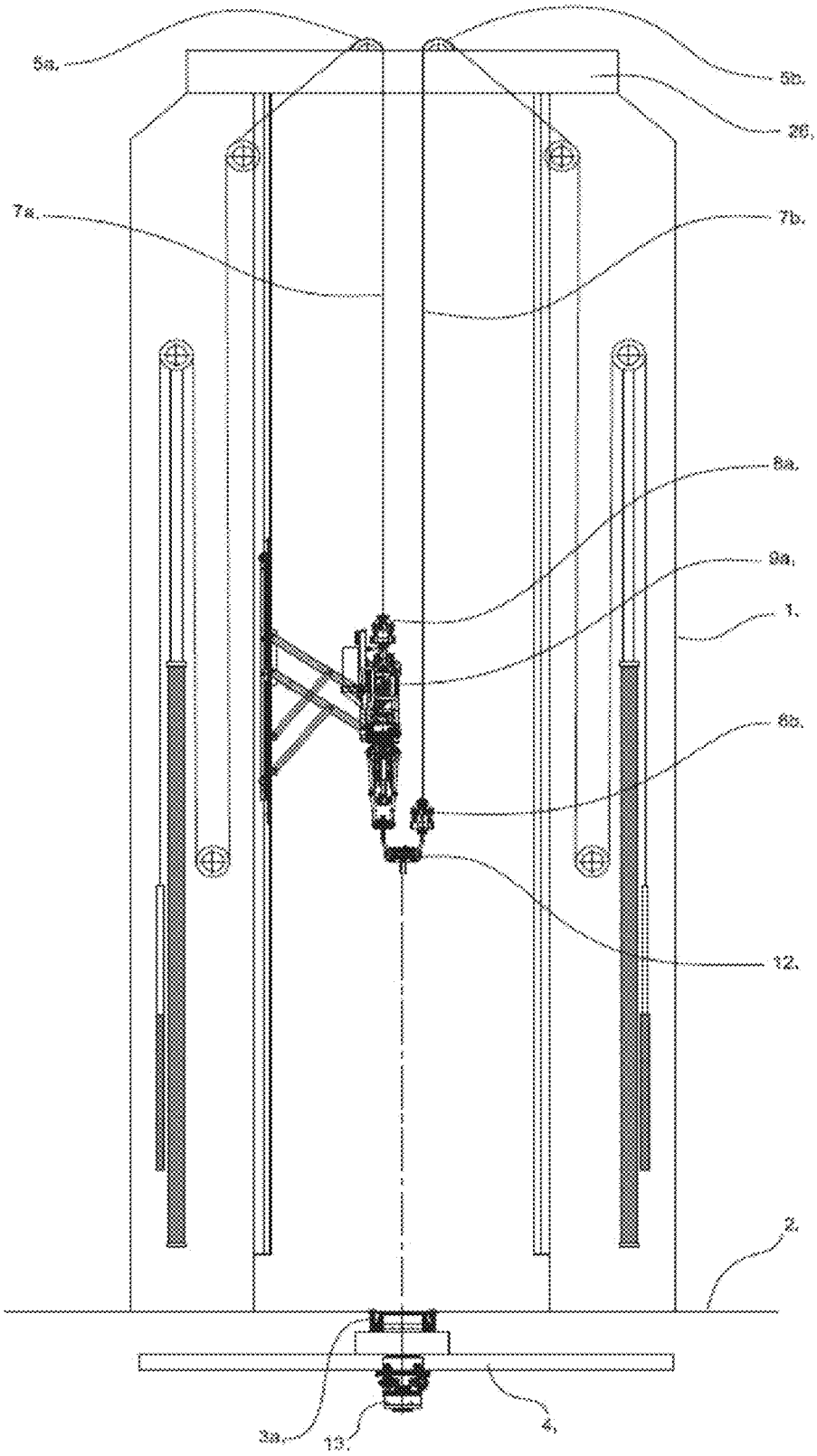
FIG. 5 is a concept drawing showing an operational mode where the two hoisting systems are operated synchronously within the same drilling facility seen from one side, enabling both hoisting systems to work over the same work center in sync for providing a double lifting capacity in the one work center, but with only one hoisting system carrying a top-drive, and with a single work center.

In FIGS. 4 and 5 a connecting tool 12 is connecting the load carriers 8*a* and 8*b* via the top drives 9*a* and 9*b* in FIG. 4 and via a single topdrive 9*a* in FIG. 5. Thereby it is possible to connect a load to the connecting tool 12, so that it is possible to provide a lifting force by combining the lifting force of both hoisting systems lifting the two load carriers 8*a* and 8*b*. The drilling rig of FIG. 4 comprises three displaceable work centers. However, as discussed in connection with the previous embodiments, the drilling rig of FIG. 4 may alternatively be provided with only two work centers, one or both of which may be displaceable. The drilling rig of FIG. 5 is shown with a single displaceable work center thus allowing the top drive 9*a* to operate above the primary well center 3*a* while the dolly 10*a* is retracted and to operate above the primary well center 3*a* together with the other load carrier 8*b* and the connecting tool 12 when the primary well center is positioned in the central position as shown in FIG. 5. However, as discussed in connection with the previous embodiments, the drilling rig of FIG. 5 may alternatively be provided with two or even three work centers, one or several of which may be displaceable.

Figure 6:
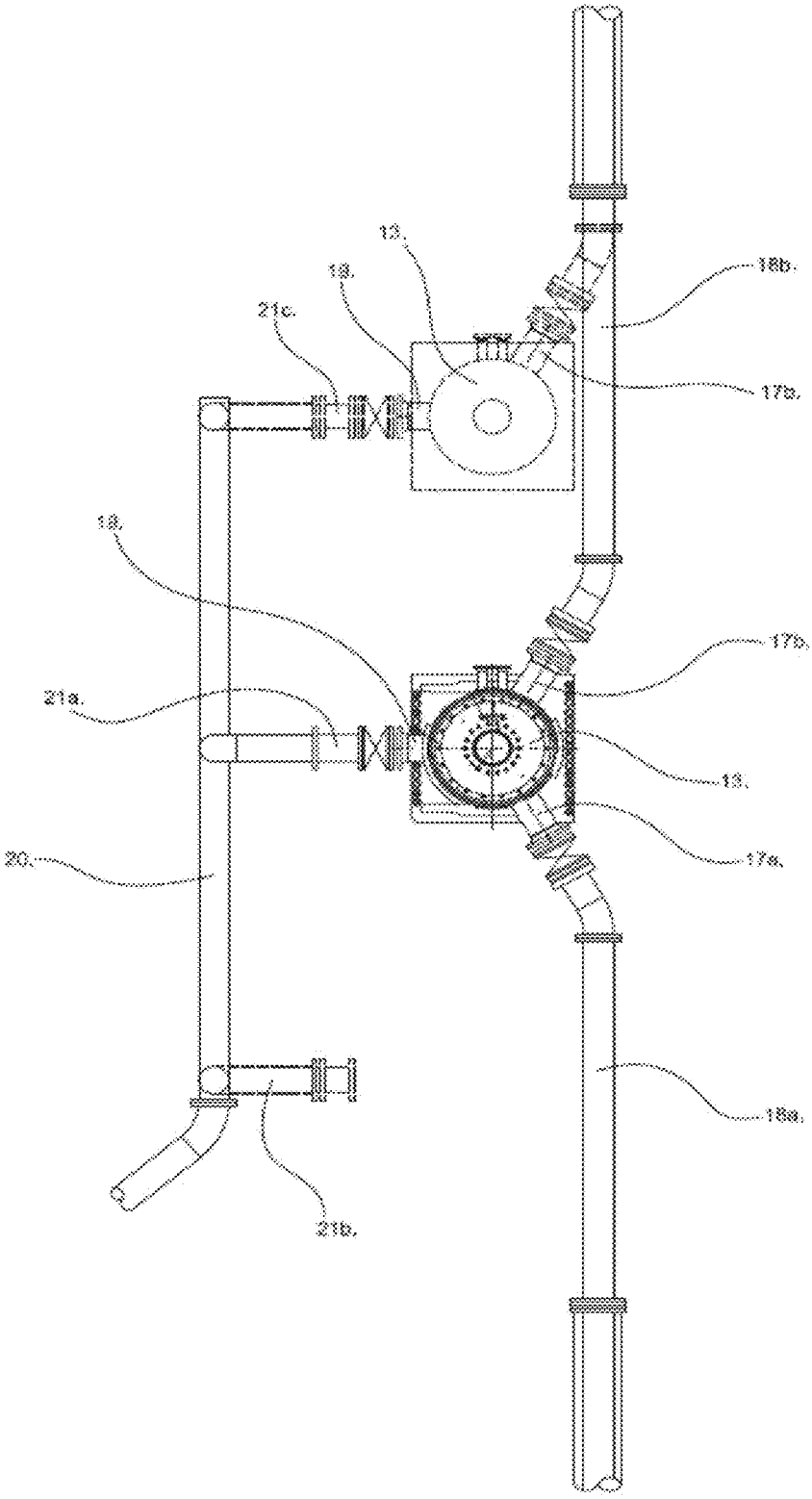
FIG. 6 is a concept drawing showing a transferable diverter housing and mud return tubing system with telescoping diverter overboard lines, seen from below.
Figure 7:
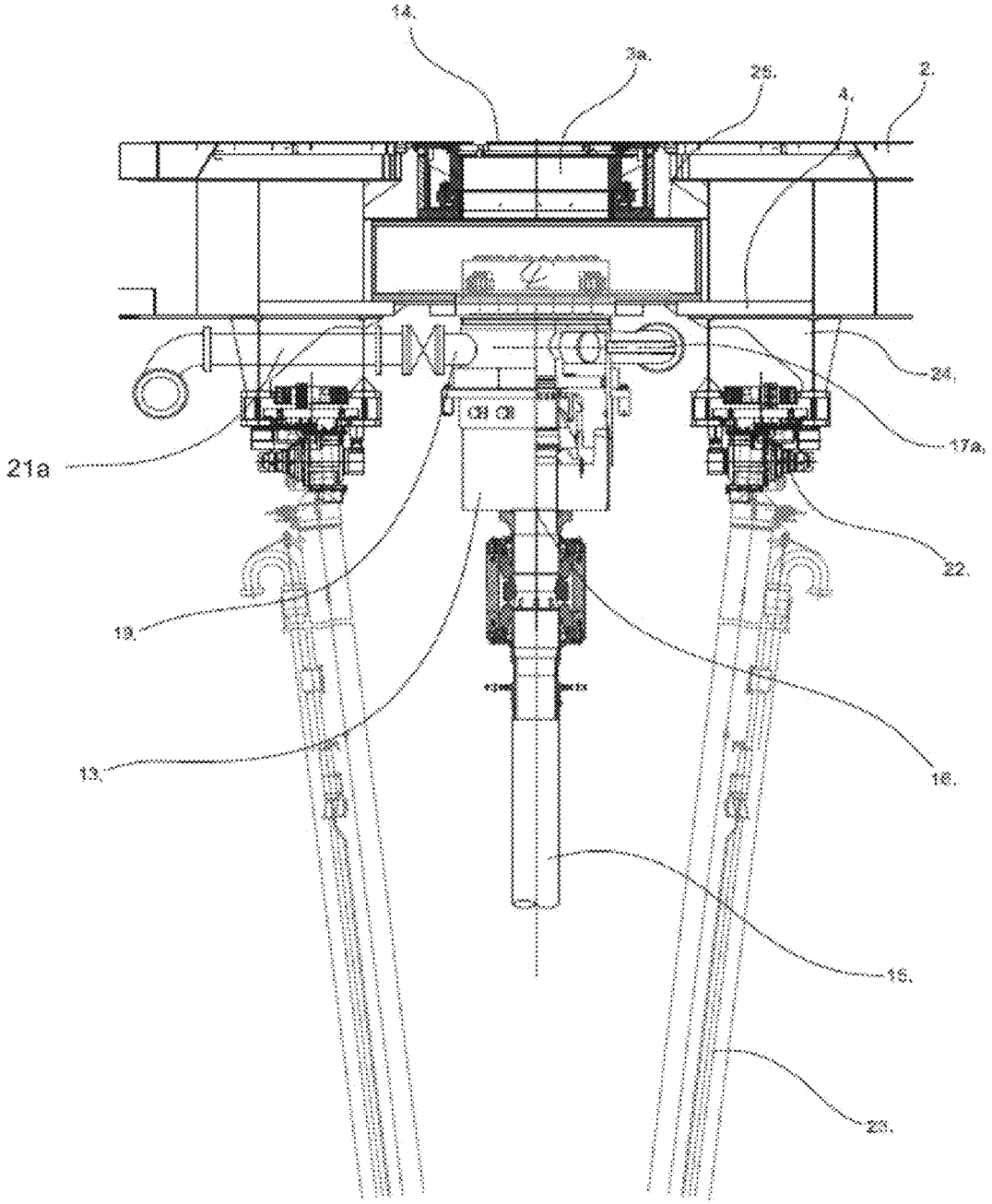
FIG. 7 is a sectional drawing showing a cross section through the center of a primary well center in the form of a rotary table supported on a transferable skidbase on tracks arranged in the drill deck, with a diverter housing suspended from underneath the said transferable skidbase and with a riser supported by in-line hydraulic riser tensioners mounted on a separate tracks below the drill deck.

FIG. 6 shows the conceptual layout of a preferred embodiment of a diverter system attached to the primary well center 3*a* such as it is shown on FIG. 7. This diverter system comprises a diverter housing 13 suspended from the skidbase 25 and supporting the rotary table 14 of the primary well center 3*a*.

The diverter housing 13 has at least two outlet ports 17*a* and 17*b* each being connected to telescopic overboard lines 18*a* and 18*b*. This allows the diverter housing 13 to be positioned at different positions along a line defined by the track 4 being parallel to the overboard lines. One such position is shown in FIG. 6 in full line, and another is shown with dotted lines.

The diverter housing 13 also comprises a mud return outlet port 19 adapted for leading drilling mud from the diverter housing back to the mud process systems via the main mud return line system 20. The mud return line comprises a number of telescopic connectors 21*a* 21*b* and 21*c* arranged at selected positions in order to connect the mud return line to the mud return outlet port 19 on the diverter housing 13. Alternatively or additionally, the mud return line 20 may comprise a telescopic section extending parallel with the track 4.

In FIG. 7, a displaceable primary well center 3*a* is shown in more detail comprising the above mentioned components and parts, and in this figure a riser tensioner system is also shown comprising skidding carriages 22 and hydraulic in-line tensioning cylinders 23 being skidably supported by a separate riser tensioner track 24 arranged parallel to and, in this example, below the track 4 supporting the rotary table skidbase 25. Thereby the riser tensioners 23 may be moved along with the rotary table and diverter housing 13 or independently of the rotary table 14 and diverter housing 13.

In the following different modes of operating the drilling rig shown in the figures are disclosed in more detail with reference to the relevant figures.

1. Full Redundancy:

With reference to FIGS. 1*a* and 1*b* especially, but not only, a fully redundant dual activity hoisting- and drilling facility is provided.

Full redundancy is achieved by having a transferable, riser-capable primary well center 3*a*, which may be positioned under either one of the top drives (e.g. 9*a* or 9*b*) and load carriers (8*a* and 8*b*) of the two fully rated main hoisting- and drilling systems comprising the facility. In this relation the primary well center may be transferred and positioned as mentioned above, with or without one tubular or a string of tubulars 35, such as riser tubes, casings, drilling pipes or the like being supported and/or hanging down from the primary well center, and these tubulars may be either hanging freely down from the primary well center, or they may extend all the way to the sea floor and further extend into the well or be connected to the well at the sea floor. In the latter case a diverter system and a tensioning system as shown on FIGS. 6 and 7 respectively may be employed along with other well control equipment.

The riser-capable primary well center 3*a* comprises a rotary table 14 supported by a horizontally transferable skid/trolley 25 that is sunk into a slot in the drill deck 2, so that the rotary table 14 top cover is substantially flush with the drill deck 2 level. Alternatively, the drill deck floor may partially extend above the rotary table.

The transferable skid/trolley 25 rests on horizontal skid beams forming a track 4 spanning the width between the two fully rated main hoisting- and drilling systems.

A diverter housing 13 with telescoping overboard lines (overboard tubing 18*a* and 18*b*) and a detachable main flowline (mud return tubing 20) is suspended from underneath the said transferable skid/trolley 25.

A transferable/skidding riser tensioning system is arranged on horizontal skid beams suspended from underneath the drill deck structure, while spanning the full width between the two fully rated main hoisting- and drilling systems.

In the following, examples are given for the intended operation to ensure full redundancy e.g. in the case that the one (active) fully rated main hoisting- and drilling system suffers a main equipment breakdown:

1. While drilling, tripping drill pipe or running casing during the riserless tophole sections of the well.
   - 1.1 the drillpipe or casing string is hung off in the power-slips/casing-spider.
   - 1.2 the drillpipe or casing string, while being suspended from the power-slips/casing-spider inside the rotary table, will be transferred to the opposite fully rated main hoisting- and drilling system.
   - 1.3 drilling, tripping drill pipe or casing running operation may resume on the opposite fully rated main hoisting- and drilling system.

Hence, in this example, only the rotary table/work center may need to be moved without requiring the diverter housing or riser tensioner system to be displaceable.

2. while running or retrieving riser and BOP
   - 2.1 the riser string and BOP is lowered and hung-off in the riser spider and gimbal, which is resting on top of the rotary table.
   - 2.2 the riser string and BOP, while being suspended from the riser spider and gimbal, will be transferred to the opposite fully rated main hoisting- and drilling system.
   - 2.3 running of the riser may resume on the opposite fully rated main hoisting- and drilling system.

Hence, in this example, only the rotary table/work center and, optionally, the spider and gimbal may need to be moved without requiring the diverter housing or riser tensioner system to be displaceable 3. while drilling, tripping drill pipe or running casing through the riser and BOP after this has been connected to the well and the riser has been put in tension.
   - 3.1 the drillpipe or casing string is hung off in the power-slips/casing-spider.
   - 3.2 the well is secured.
   - 3.3 the drillpipe or casing string, while being suspended from the power-slips/casing-spider inside the rotary table, will be transferred to the opposite fully rated main hoisting- and drilling system.
   - 3.4 the diverter housing with telescoping overboard lines and detachable main flowline, suspended from below the transferable. skid/trolley supporting the rotary table, will be transferred to the opposite fully rated main hoisting- and drilling system.
   - 3.5 in fully synchronous motion, the riser string, while being suspended from the riser tensioners will be transferred to the opposite fully rated main hoisting- and drilling system.
   - 3.6 drilling, tripping drill pipe or casing running operation may resume on the opposite fully rated main hoisting- and drilling system.

Hence, in this example, the rotary table/work center and the diverter housing and riser tensioners may need to be moved.

The fully redundant dual activity hoisting- and drilling facility illustrated in FIGS. 1*a* and 1*b* will allow for continued operation on either port or starboard side hoisting- and drilling system (by repositioning of the primary well center), while the opposite side is decommissioned for any extended period of time, e.g. for Class required Special Periodic Survey, breakdown or other reason.

2. Cyclic Dual Hoisting:

With reference to FIGS. 2*a* and 2*b* especially, but not only, a cyclic dual hoisting facility is provided especially for Fast Tripping, Casing- or Riser Running:

Fast tripping, casing- or riser running operation is ensured by having two independent and fully redundant hoisting- and drilling systems including top drives 9*a* and 9*b* working in cyclic operation over a common primary well center 3*a*.

Each hoisting system comprises a horizontally transferable cable crown in the form of a crown sheave cluster arrangement 5*a*, 5*b*, allowing the crown sheave cluster 5*a*, 5*b* to be horizontally transferred, aligned and locked into position over at least two independent positions/well centers 3*a*, 3*b*, 3*c* on the drill deck 2 below.

Each hoisting system supports a vertically travelling load carrier 8*a*, 8*b* arrangement, from which a topdrive 9*a*, 9*b* is suspended below on a horizontally extend-/retractable dolly 10*a*, 10*b* system for guiding of the topdrive 9*a*, 9*b*.

The extend-/retractable dolly 10*a*, 10*b* shall have a horizontal travel corresponding with the horizontal travel of the crown sheave cluster 5*a*, 5*b* arrangement above, while extending/retracting horizontally in synchronous motion with the skidding crown sheave cluster 5*a*, 5*b* arrangement above, ensuring that the hoisting system is kept in true vertical alignment with the cable sheave cluster/load carrier/yoke/hook arrangement and the topdrive 9*a*, 9*b* suspended underneath it.

In the following typical examples are given for the intended cyclic operation of the dual hoisting and drilling facility to provide fast tripping, casing or riser running operation:

1. Tripping/running in the hole: low setback and pipe racking system off-drill deck.
2. Tripping/running in the hole: setback and pipe racking system on-drill deck.

Fast running or retrieval of the riser and BOP may be performed in a similar cyclic operation, while employing suitable arrangements for facilitating handling of the riser joints to/from the primary well center 3*a* with this being in the center position.

An added benefit of the invention is the full redundancy provided within this facility in that each hoisting and drilling system will offer full redundancy for the other system in the center operating position.

3. Synchronous Dual Hoisting:

With reference to FIG. 4 especially, but not only, a synchronous dual hoisting facility is provided for heavy duty well construction.

The synchronous hoisting facility is realized by utilizing the two independent and fully redundant hoisting- and drilling systems in a combined synchronous mode of lifting operation above the common primary well center 3*a*, by using a connecting tool 12.

In FIG. 4 the synchronously hoisting facility comprises two topdrives, but as shown in FIG. 5 it is possible to operate the hoisting systems synchronously even when only one topdrive 9*a* is used. In this situation the connecting tool 12 is carried by the topdrive 9*a* on one side, but is directly connected to the hoisting cable via the load carrier 8*b* at the other side.

This principle allows for extra heavy duty lifting operation without necessitating any of the two hoisting- and drilling systems to be rated beyond the current design loads of such equipment, where especially the load capacity of the topdrives 9*a*, 9*b* are limiting the load capacity of the hoisting systems.

Recurring requests for rigs capable of running extended sections of heavy wall casing strings through deep formations in ultra-deep water may require lifting facilities of 1500 metric tons SWL or beyond.

Current designs of hoisting and drilling systems are limited to approx. 1200 metric tons only, with systems and equipment currently under design and development for up to 1500 metric tons.

Consequently, the next generation of DW drilling rigs may only provide incrementally larger hoisting capacity compared with the current generation of rigs and will therefore restrict well designs to within the 1500 metric tons limit of the next generation of top drives.

However, this invention will allow for hoisting and lowering loads exceeding 2000 metric tons, limited only by the structural integrity and load carrying capacity of the casing and landing string tubulars, running- and handling tools.

A generic ultra-deep subsalt and/or HPHT well development program in ultra-deep water might utilize some or all aspects of embodiments of the drilling rig disclosed herein, e.g. through the following steps and transitions between modes of operation:

1. Dual activity operation for concurrently drilling tophole sections, while running and cementing casing down to and including the 18" casing section (e.g. using a configuration as illustrated in FIG. 1*a*).
2. Dual activity operation for concurrently running riser and BOP, while cementing the 18" casing section, incorporating full redundancy (e.g. using a configuration as illustrated in FIG. 1*a*).
3. Transferring the primary well center 3*a* with riser and BOP suspended to the center position with subsequent landing of the BOP (e.g. using a configuration as illustrated in FIG. 2*a*).
4. Drilling, tripping and running casing in cyclic operation through riser with primary well center 3*a* in center position (e.g. using a configuration as illustrated in FIG. 3).
5. Running and landing extra-long heavy casing sections in synchronous dual hoisting mode (e.g. using a configuration as illustrated in FIG. 4).

Figure 8:
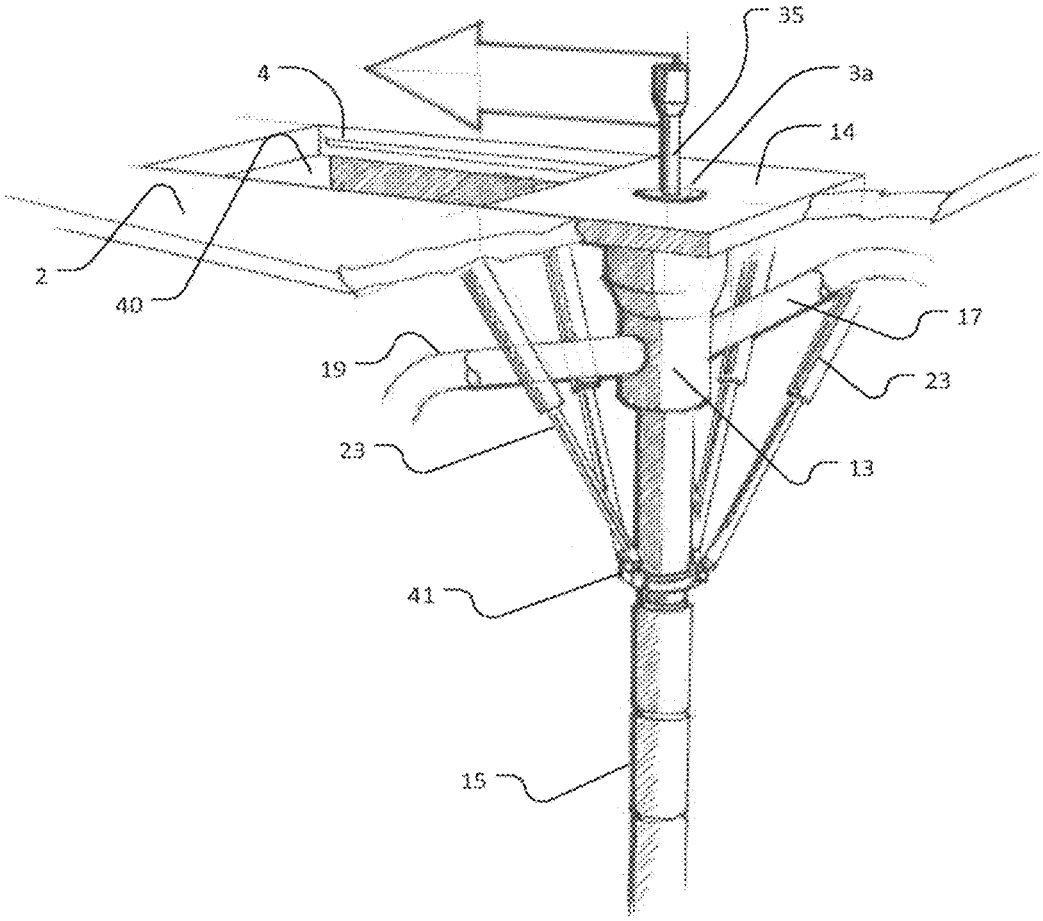
FIG. 8 is a concept drawing showing a transferable primary well center, diverter system and riser tensioning system.

FIG. 8 is a concept drawing showing a displaceable primary well center, diverter system and riser tensioning system. In particular, FIG. 8 shows a part of the drill deck 2 including a displaceable primary well center 3*a*. The well center is defined by hole of a rotary table 14 that is skidable along tracks 4 in the drill deck. In the example of FIG. 8 the rotary table has a top surface that is flush with the upper surface of the drill deck, and the drill deck defines a slot 40 having a width matching the size of the rotary table. In other embodiments, the slot may be narrower, e.g. by letting the drill deck surface extend partially across the rotary table. Alternatively or additionally, the slot 40 may be covered by plates or hatches which may be removed during the skidding of the well center. The drilling rig of FIG. 8 further comprises a diverter system comprising a diverter housing 13 from which outlet ports 17 and 19 extend. The diverter housing is mounted below the well center 3*a* and arranged to be skidable together with the well center 3*a*. For example, the diverter housing may be suspended from a skidbase supporting the rotary table, as described in connection with FIG. 6 above. The drilling rig of FIG. 8 further comprises a riser tensioning system comprising hydraulic in-line tensioning cylinders 23 being skidably supported by a separate riser tensioner track (not explicitely shown in FIG. 8) arranged parallel to the track 4 supporting the rotary table 14, e.g. as described in connection with FIG. 6. Thereby the riser tensioners 23 may be moved along with the rotary table and diverter housing 13. The riser tensioning cylinders are, at their lower end, connected to a tensioner ring 41 which engages a marine riser string 15 so as to control the tension on the riser string. In the example of FIG. 8, the rotary table 14, the diverter housing 13 and the riser tensioners 23 with the riser string 15 suspended from it may individually or jointly be skidded in the direction indicated by an arrow in FIG. 8. As is further illustrated in FIG. 8, the above components may even be jointly skidded while a string of pipe 35 is suspended in the rotary table 14 and extends downward through the riser 15.

Figure 9:
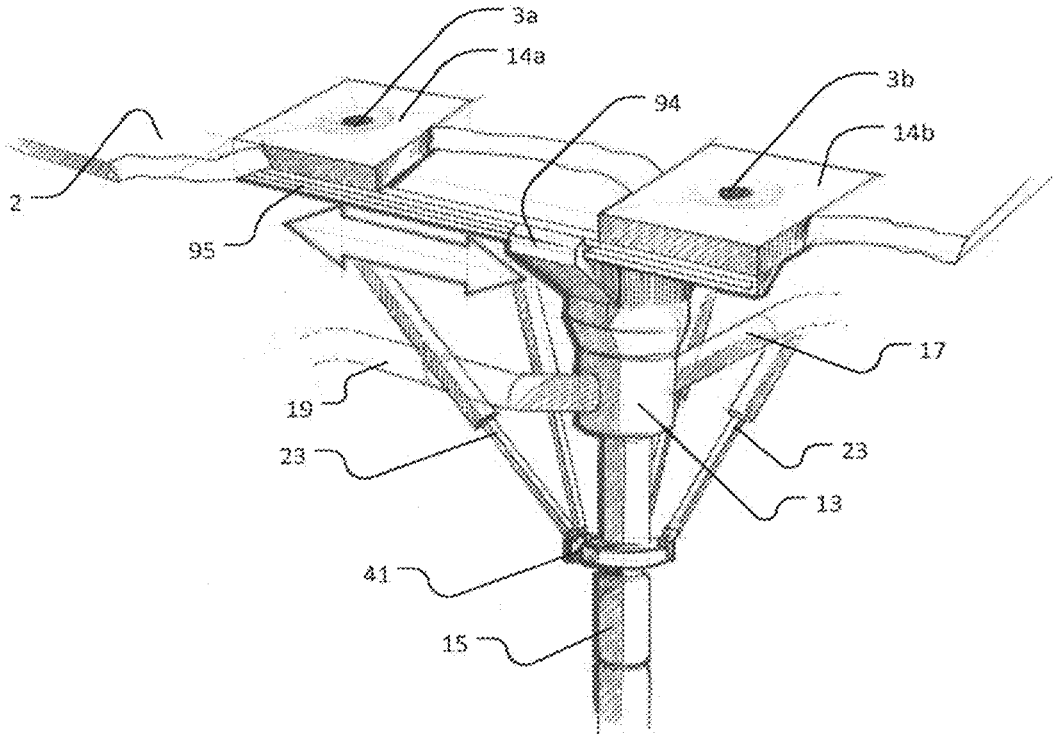
FIG. 9 is a concept drawing showing a transferable diverter system and riser tensioning system.

FIG. 9 is a concept drawing showing a displaceable diverter system and riser tensioning system. In the example of FIG. 9, the drilling rig comprises two stationary rotary tables 14*a,b*, each defining a work center 3*a,b*, respectively, that is operable as a primary well center. The work centers 3*a,b* thus define respective first and second horizontal positions. The drilling rig of FIG. 9 further comprises a diverter system comprising a diverter housing 13 from which outlet ports 17 and 19 extend. The diverter housing is mounted below the drill deck 2 and arranged to be skidable along tracks 95 extending between the rotary tables 14*a,b*. To this end, the diverter housing comprises carriages 94 movably attached to the tracks 95. The drilling rig of FIG. 9 further comprises a riser tensioning system comprising hydraulic in-line tensioning cylinders 23 being skidably supported by a separate riser tensioner track (not explicitly shown in FIG. 8) arranged parallel to the tracks 95 that supports the diverter housing 13, e.g. as described in connection with FIG. 6. Thereby the riser tensioners 23 may be moved along with the diverter housing 13 between positions under the respective work centers 3*a,b*. The riser tensioning cylinders are, at their lower end, connected to a tensioner ring 41 which engages a marine riser string 15 so as to control the tension on the riser string. In the example of FIG. 9, the diverter housing 13 and the riser tensioners 23 with the riser string 15 suspended from it may jointly be skidded in the direction indicated by an arrow in FIG. 9. Consequently, the work centers may selectively be operated as primary well center so as to obtain an increased redundancy, e.g. in case of a failure of a hoisting system that operates above one of the work centers.

Figure 10:
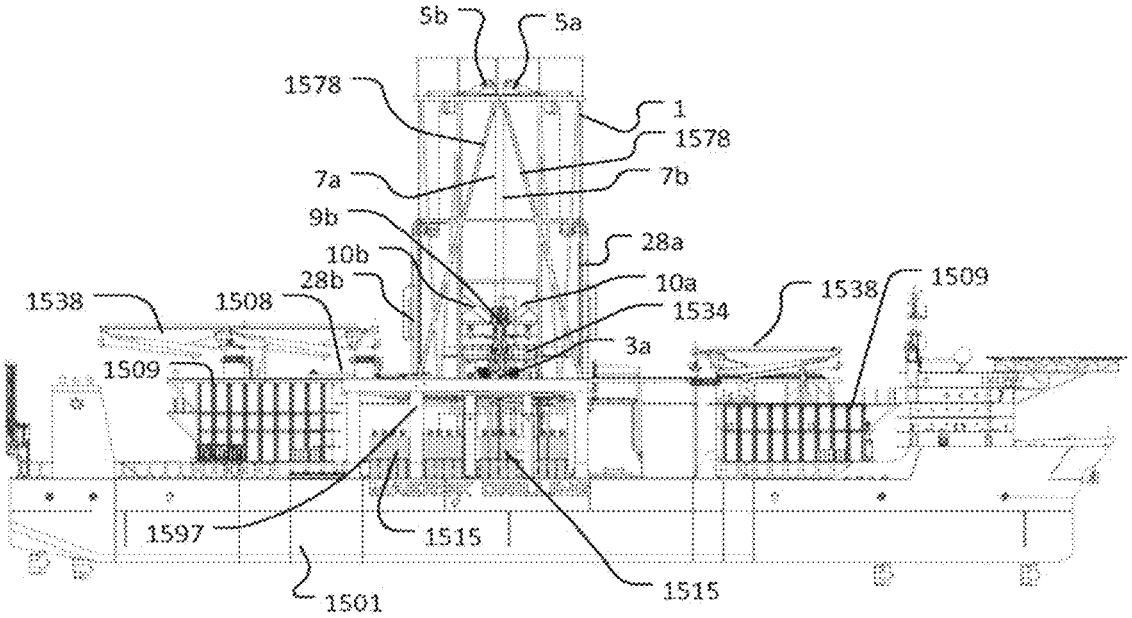
Figure 11:
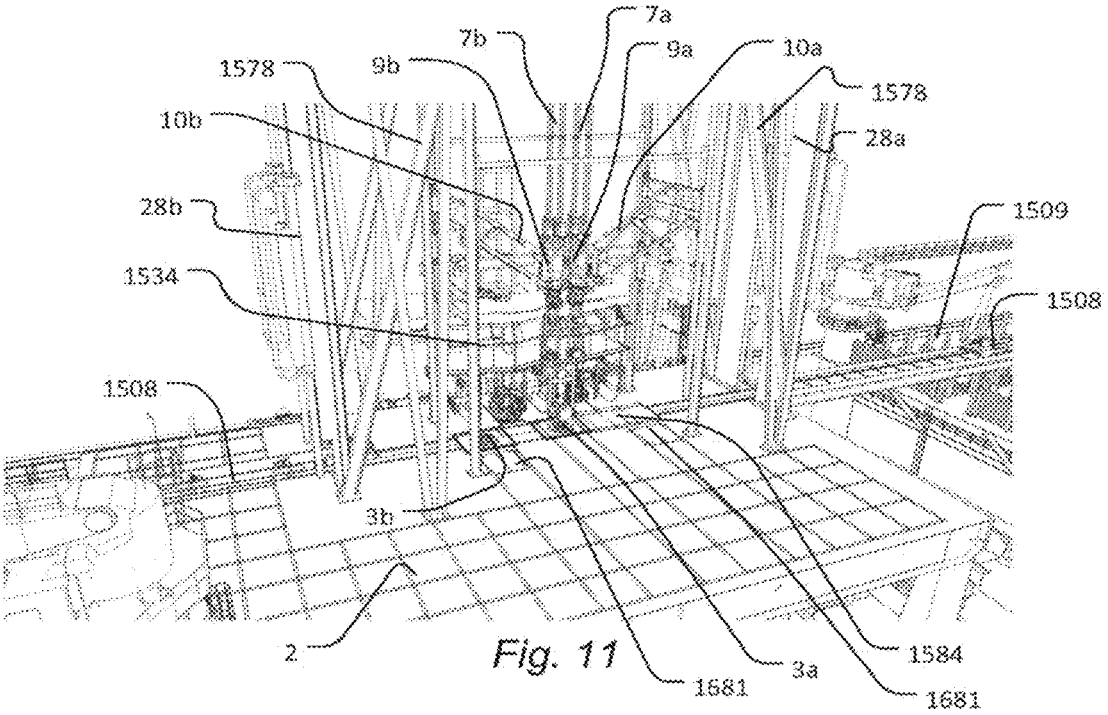
Figure 12:
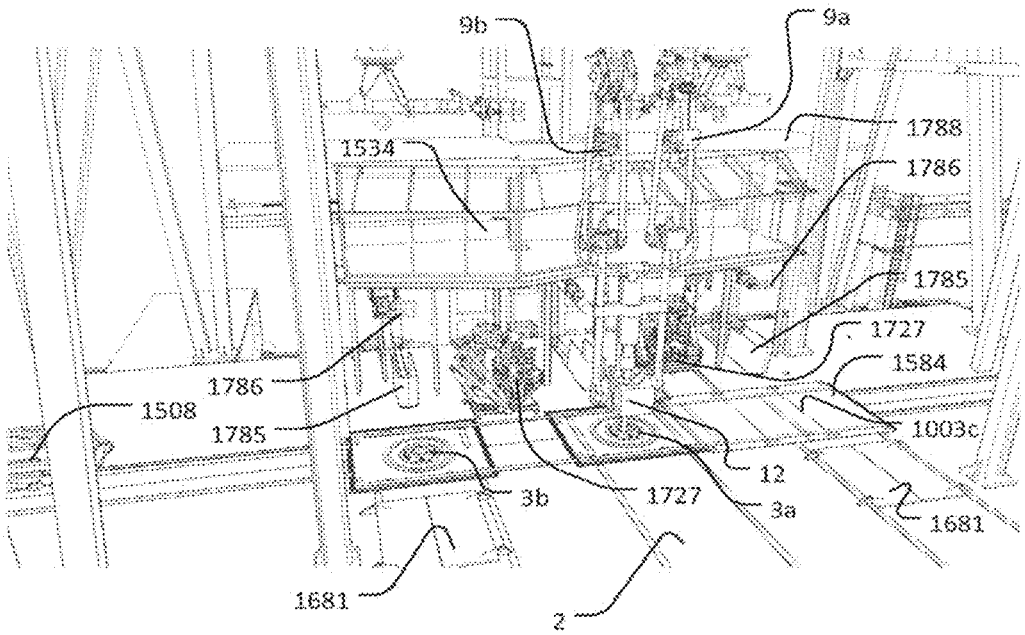
Figure 13:
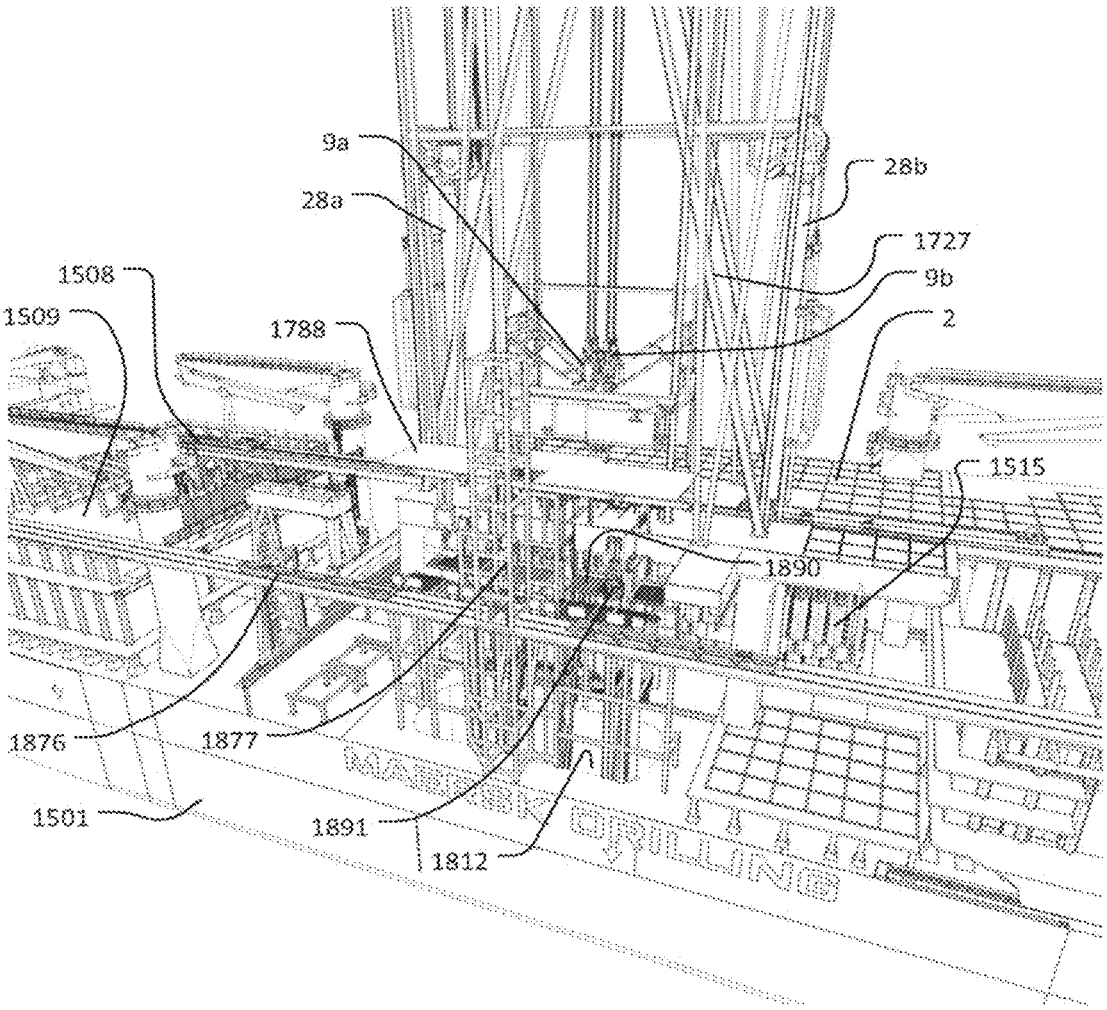
Figure 14:
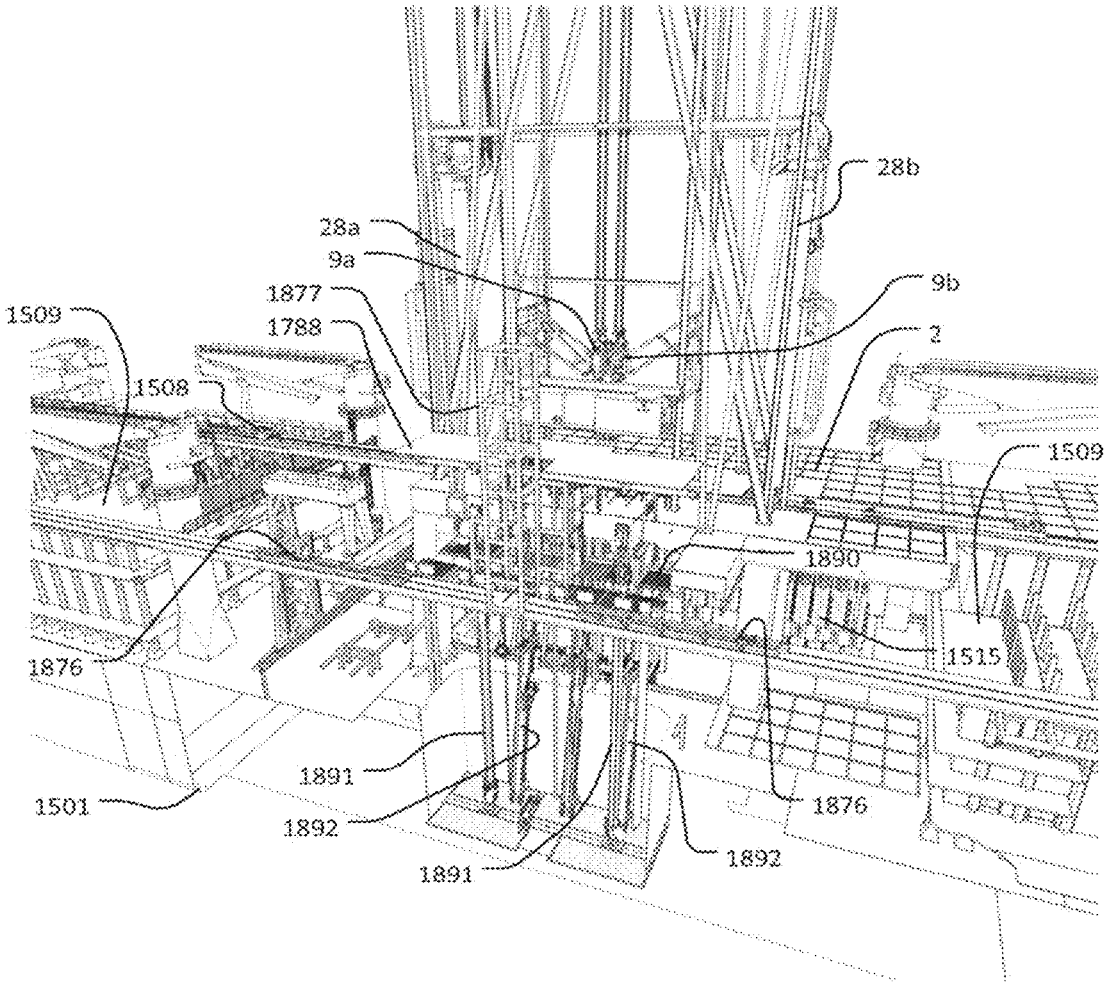
Figure 15:
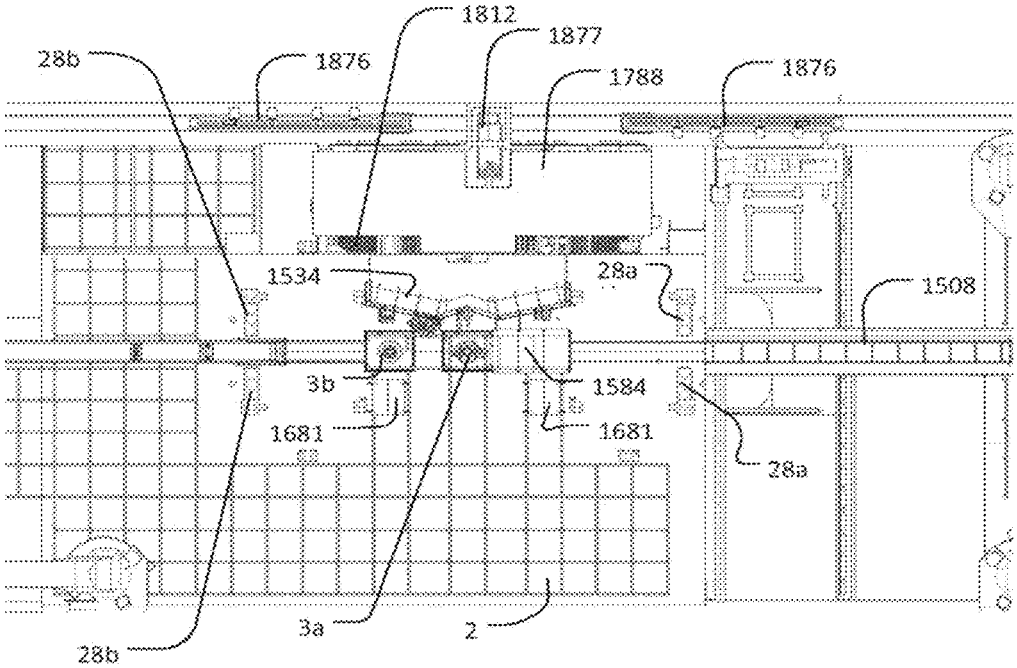
Figure 16:
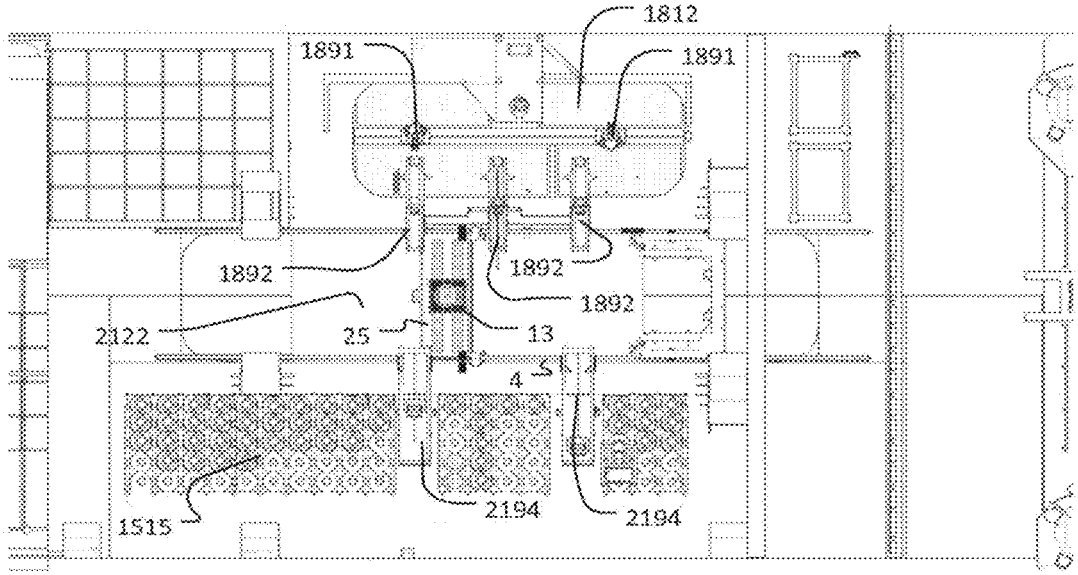
Figure 17:
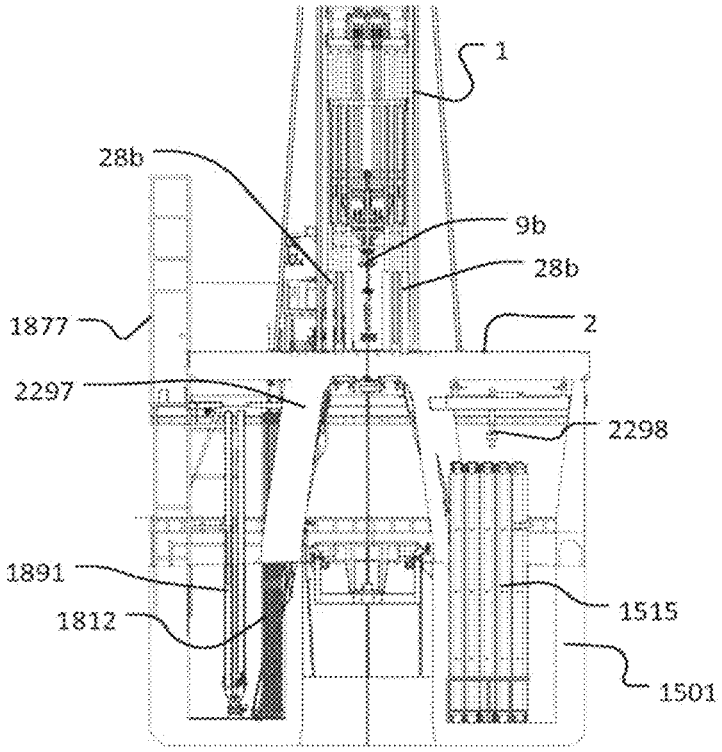
Figure 18:
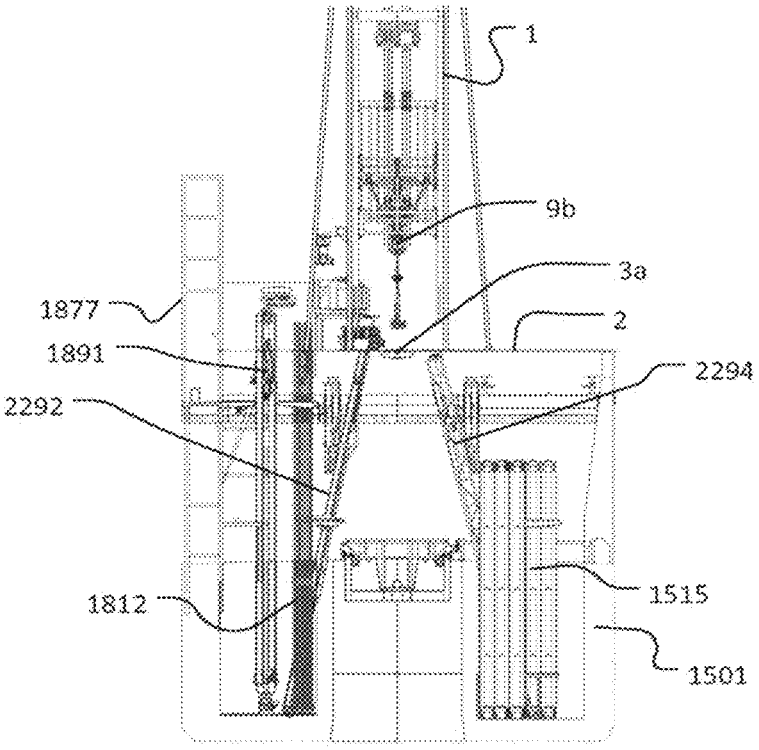

FIGS. 10-18 show another embodiment of a drilling rig, in this example of drillship having a hull 1501. In particular, FIG. 10 shows a side view of the drilling rig, FIGS. 11 and 12 show views of the drill floor seen from the starboard side of the drillship, FIGS. 13 and 14 show views of the drill floor seen from the port side of the drillship (a part of the hull of the ship is cut away in FIG. 14); FIGS. 15 and 16 show horizontal cross sections in a plane above the drill deck and a plane below the drill deck, respectively; finally, FIGS. 17 and 18 show lateral cross sections of the drill ship.

The drilling rig of the present embodiment comprises a drill deck 2 formed on top of a substructure 1597. The substructure comprises a platform supported by legs. The platform defines the drill deck and spans across a moon pool 2122 formed in the hull of the drillship. The drill deck 2 comprises two holes defining well centers 3*a,b*. The drilling rig comprises a drilling support structure in the form of a mast 1. In the present example, the well centers are located within the footprint of the mast 1. The mast includes two mast portions, each associated with, and adjacent to, one of the well centers. The dual activity mast 1 is supported by the substructure 1597 and extends upwardly from the drill deck 2. The mast comprises two mast portions arranged in a face-to-face configuration, i.e. the respective mast portions are located along the axis connecting the well centers such that both well centers are located between the mast portions. Each mast portion supports a hoisting system, each for lowering a drill string through a respective one of the well centers 3*a,b* towards the seabed. In the example of FIGS. 10-18, the drilling rig comprises two well centers, one of which being operable as a primary well center 3*a* and being equipped with a diverter housing 13. The primary well center 3*a* is supported on a skidbase 25 on tracks 4 arranged below the drill deck (e.g. as shown in more detail in FIGS. 7 and 8) so as two allow the well center and the diverter housing 13 to be displaced along the direction connecting the two well centers. Alternatively, both work centers may be provided with a diverter and be operable as primary well centers. The skidbase extends across the moon pool, and the tracks are mounted on opposite sides of the moonpool and they extend along the direction connecting the well centers. The drilling rig may further comprise a skidable riser tensioning system as described in connection with FIGS. 7 and 8. The primary well center 3*a* may be moved between a first, central horizontal position, as shown in FIGS. 12 and 13, and a second, peripheral position 1003*c*, where the first position is located on the axis connecting the second position 1003*c* and the work center 3*b* which is located at a third horizontal position. In the present example, the first position is positioned substantially in the center between the second position 1003*c* and the work center 3*b*. The position not currently occupied by the displaceable well center (e.g. the second position 1003*c* in FIGS. 12 and 13) may be covered by floor plates or a similar cover 1584. In alternative embodiments, both well centers may be displaceable. In yet another embodiment, the drilling rig may comprise three well centers, e.g. aligned along a common axis. Each of the two hoisting systems may be operable to lower tubulars selectively through a work center at each of at least two horizontal positions, such as the central position (where the primary well center 3*a* is located in the example of FIG. 12) and one of the peripheral positions (the position of the work center 3*b* and the second position 1003*c*). To this end, the mast 1 carries two cable crowns 5*a,b*, e.g. in the form of a crown sheave cluster or in the form of a crown block, being skidably arranged on the top of the mast on separate tracks.

From each of the cable crowns lifting cables 7*a,b* are running down and connect to a corresponding top drive 9*a,b* which is suspended from a hook or other load carrier connected to the lifting cables. Each of the top drives is connected via a retractable dolly 10*a,b* to a vertical track arranged at the mast 1. The retractable dollies are each adapted so that they can position and keep the top drives in different positions above the well centers, as described herein.

Each hoisting system has one or more linear actuators in the form of a hydraulic cylinder 28*a,b* having its lowermost end fixed with respect to the drill deck and an upper travelling end with a cable sheave. At least one lifting cable has one end extending from another hydraulic cylinder arranged for compensating heave during e.g. drilling operation, and over the travelling cable sheave and further below a second cable sheave being fixed with respect to the mast, and thereafter over the cable crown. The hydraulic cylinders are displaced from the well centers along the direction connecting the well centers and positioned such that both well centers are located between the cylinders of the respective hoisting systems. As can be most easily seen on FIG. 20, the cylinders of each hoisting system are further (optionally) arranged in two groups of cylinders positioned on either side of an axis connecting the well centers so as to form a gap through which a catwalk machine 1508 or other pipe handling equipment can travel and feed tubulars to one or both of the well centers. Each cable crown 5*a,b* defines an axis that is parallel to the direction connecting the two groups of cylinders of one of the hoisting systems.

As is most easily seen in FIG. 12, both hoisting systems may cooperate so as together to lower or raise tubulars through the same well center, e.g. the primary well center when located at a central position as illustrated in FIG. 12. To this end, a connecting tool 12 may be arranged to connect the top drives 9*a,b*. In this example, the connecting tool is in the form of an elevator and bail sections connected to said elevator in one end and suitable for being lifted by second elevators each connect to a top drives 9*a,b* via bails in the conventional manner. A stabbing and circulation device (e.g. in the form a Casing Fill-Up and Circulating System tools or FLOW BACK & CIRCULATION TOOLS FOR DRILL PIPE (CFT)) is mounted between the bail sections and further connected to a mud connection, preferably of one or both (as illustrated here) of the top drives. Thereby it is possible to connect a load to the connecting tool 12, so that it is possible to provide a lifting force by combining the lifting force of both hoisting systems lifting the connecting tool. To better support increased loads, the mast comprises diagonal beams 1578 forming an inverted V. In alternative modes of operation, the two hoisting systems may be operated above respective well centers or they may be operated in a cyclic dual hoisting mode over a single well center, e.g. as described herein.

The drilling rig further comprises a pipe storage area 1509 for storing pipes in horizontal orientation and catwalk machines 1508 or other horizontal pipe handling equipment for transporting pipes between the storage area 1509 and the well centers 3*a,b*. To this end, the catwalk machines are aligned with the axis defined by the two well centers.

The drilling rig comprises a setback structure 1812 or similar pipe storage structure for storing stands of tubulars below the substructure 1597 and partly covered by the drill deck 2. The setback structure comprises a support framework 1890 supporting fingerboards having horizontally extending fingers between which tubulars may be stored. The setback structure is arranged so as to allow stands to be moved to/from both well centers from/to the setback. To this end, one or more column rackers 1891 or similar vertical pipe handling equipment may be arranged to move stands into and out of the setback structure 1812. The setback structure 1812 further comprises stand building equipment 1877 configured to build stands from individual pieces of pipe. The setback structure 1812 is located adjacent the moon pool 2122 laterally displaced from the axis defined by the well centers.

Moreover the drilling rig comprises one or more further catwalk machines 1876 configured to feed tubulars from the pipe storage area 1509 or from other storage areas on the opposite side of the mast (towards the aft of the ship) to the stand building equipment 1877. The stand building equipment 1877 may thus receive the pipes from the catwalk machine 1876, bring them in upright orientation, and connect them to other pieces so as to form stands. To this end the stand building equipment may comprise a mousehole through which the stand may be gradually lowered while it is made up until the lowermost end of the stand is at the lowermost level of the setback area 1812, while the uppermost end of the stand is below the drill floor level. The stands may then be received by pipe rackers 1891 and placed in the setback structure 1812 for future use. To this end the pipe rackers are operable to traverse across the setback area, e.g. in the direction parallel to the direction connecting the well centers.

The drilling rig comprises a number of slanted chutes 1892 each for feeding pipes from the setback area 1812 to one of the well centers. To this end the drilling rig may comprise one chute for each well center position, i.e. either the fixed well-center positions or the positions to which a skidable well center can be moved. Alternatively, the chutes may be displaceable so as to be selectively aligned with respective well centers. Each chute 1892 receives pipes from one of the pipe rackers 1891 and feed the pipes in a slanted upward direction through a corresponding slit 1785 in the drill floor towards a respective one of the well centers 3*a,b*, where they are picked up at their uppermost end by the corresponding hoisting system and lifted through the slit 1785 until they are vertically suspended above the corresponding well center. To this end, the drilling rig further comprises pipe handling equipment 1786 operable to guide the pipes while they are being lifted through the slit 1785. The slits 1785 are elongated and point away from the axis connecting the well centers and towards the side where the setback area 1812 is positioned. To allow for the pipes to be presented in this fashion, the driller's cabin 1534 is positioned at an elevated level above the slits 1785. One or more further pipe handling devices, such as iron roughnecks 1727, may be located between neighbouring slits and underneath the driller's cabin, e.g. such that each iron roughneck may service two well center positions.

The drilling rig comprises another storage area 1515 below the drill deck 2 and configured for storing risers in a vertical orientation. The riser storage area 1515 is located adjacent the moon pool 2122, e.g. on the side of the moon pool opposite the setback structure 1812. The risers may then be moved, e.g. by means of a gantry crane 2298 and respective chutes 2294 or other suitable pipe feeding equipment through holes 1681 in the drill deck floor. The riser feeding holes 1681 may be covered by removable plates, hatches or similar covers, as illustrated in e.g. FIGS. 13 and 15. The riser feeding holes are displaced from the axis connecting the well centers.

As the stands of tubulars and the risers are stored below the drill deck, and since the cat walk machines 1508 extend towards opposite sides from the well centers, and since the mast structure 1 is located on one side of the well centers, the drill deck provides a large, unobstructed deck area on the side of the well centers opposite the mast. This area provides unobstructed access to both well centers and is free of pipe handling equipment. Consequently, these areas may be used as working area, e.g. for rigging up suspendable auxiliary equipment, and/or for positioning on-deck auxiliary equipment. Moreover, at least parts of the setback structure 1812 may be covered by a platform 1788 so as to provide additional storage or working area.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore drilling rig comprising:

a drill deck;

a first work center arranged in the drill deck;

a first hoisting system adapted for raising or lowering tubular equipment through the first work center;

a second work center arranged in the drill deck horizontally spaced apart from the first work center;

a second hoisting system adapted for raising or lowering tubular equipment through at least the second work center;

a riser tensioning system operable to provide tension to said riser;

wherein the offshore drilling rig comprises a first positioning system configured for positioning at least the riser tensioning system selectively at a first horizontal position and a second horizontal position, different from the first horizontal position; and wherein the first and second work centers are both primary well centers, each comprising a diverter system arranged below the primary well center, each diverter system operatively connectable to a riser extending towards the seafloor, and the first hoisting system is operable to raise or lower tubular equipment through the said riser at least when said riser tensioning system is positioned at said first horizontal position and the drilling rig is operable to raise or lower tubular equipment through the said riser by means of at least the second hoisting system when the riser tensioning system is positioned at said second horizontal position.

2. An offshore drilling rig according to claim 1, wherein the drilling rig is operable to raise or lower tubular equipment through the first work center and said riser by means of at least the first hoisting system when the riser tensioning system is positioned at said second horizontal position.

3. An offshore drilling rig according to claim 1, wherein the drilling rig is arranged so that the first and second hoisting systems can operate simultaneously to raise or lower tubulars in and out of the first and second work centers, respectively, while the second work center occupies the second horizontal position.

4. An offshore drilling rig according to claim 1, wherein the drilling rig is operable to raise or lower tubular equipment through the second work center and said riser by means of at least the second hoisting system when the riser tensioning system is positioned at said second horizontal position.

5. An offshore drilling rig according to claim 1; wherein the second hoisting system is operable to raise or lower tubular equipment through the diverter system by means of at least the second hoisting system when the diverter system is positioned at said second horizontal position.

6. An offshore drilling rig according to claim 1; wherein the first positioning system is configured to selectively position the diverter system at the first and the second horizontal positions while the second work center is positioned at a third horizontal position, different from the first and second horizontal positions.

7. An offshore drilling rig according to claim 1; wherein the first and second hoisting systems are operable to separately or together raise or lower tubular equipment through said first work center at said first horizontal position.

8. An offshore drilling rig according to claim 1, wherein the first and second work centers are mounted in a substantially horizontal track, and where the first positioning system is adapted for selectively moving and positioning each of the work centers in the horizontal track to a first or a second or a third position in the drill deck.

9. An offshore drilling rig according to claim 8, wherein the horizontal track is linear at least along a part of it, and where its respective diverter system is connected to the first work center and comprises at least one diverter having a first end being connected to the first work center and the other end being supported and fixed with respect to the drill deck and the diverter having at least one telescopic section between the first and the second end, the telescopic section extending parallel to a linear part of the horizontal track in the drill deck.

10. An offshore drilling rig according to claim 1, wherein at least one of the diverter systems is displaceable.

11. An offshore drilling rig according to claim 1; wherein the first hoisting system is configured to raise or lower a first load carrier, and the second hoisting system is adapted to raise or lower a second load carrier; and wherein the drilling rig comprises a second positioning system configured for positioning at least a displaceable one of the first and second load carriers at the first horizontal position and the second horizontal position.

12. An offshore drilling rig according to claim 1, wherein the first work center is displaceable between the first and second horizontal positions and wherein the first work center and a first load carrier are displaceable along parallel paths.

13. An offshore drilling rig according to claim 1, wherein the first and second hoisting systems comprise respective first and second lifting cables hanging from respective first and second cable crowns each supported by a drilling support structure, and where the second positioning system is adapted for shifting at least one of or each of the cable crowns so as to move at least a displaceable load carrier to and from the first and the second horizontal position.

14. An offshore drilling rig according to claim 1, comprising at least one top drive suspended from the first load carrier.

15. An offshore drilling rig according to claim 1, wherein each of the first and second hoisting systems comprises at least one substantially vertically extending linear actuator, such as a hydraulic cylinder, having a stationary end being fixed with respect to the drill deck, and a travelling end comprising at least one cable sheave.

16. An offshore drilling rig according to claim 1, wherein the diverter system is mounted on a track extending between the first and second horizontal positions.

17. An offshore drilling rig according to claim 1, wherein the riser tensioning system and the first positioning system are configured so that the riser tensioning system can be moved from the first horizontal position to the second horizontal position, and vice versa, while the diverter system is connected to the riser extending towards the seafloor.

18. A method of performing drilling operations by using an offshore drilling rig, the drilling rig comprising:

a drill deck;

a first work center and a second work center arranged in the drill deck horizontally spaced apart from each other, both work centers being operable as a primary well center each comprising a diverter system arranged below the primary well center, each diverter system operatively connectable to a riser extending towards the seafloor, and;

a first hoisting system adapted for raising or lowering tubular equipment through at least the first work centers;

a second hoisting system adapted for raising or lowering tubular equipment through at least the second work centers; and a riser tensioning system;

and wherein the method comprises:

positioning the riser tensioning system at a first horizontal position;

performing drilling operations through the riser center by means of at least the first hoisting system;

moving the riser tensioning system from the first to a second horizontal position, different from the first horizontal position; and continuing drilling operations through the riser work center by means of at least the second hoisting system.

19. A method according to claim 18, wherein said drilling operations are performed using the first hoisting system is performed through the first work center.

20. A method according to claim 18, wherein said drilling operations performed using the second hoisting system are performed through the second work center.

21. A method according to claim 18, wherein a riser is connected to the riser tensioning system when the riser tensioning system is moved from said first horizontal position to said second horizontal position.

* * * * *